US008587492B2

(12) United States Patent
Runyon

(10) Patent No.: US 8,587,492 B2
(45) Date of Patent: Nov. 19, 2013

(54) DUAL-POLARIZED MULTI-BAND, FULL DUPLEX, INTERLEAVED WAVEGUIDE ANTENNA APERTURE

(75) Inventor: Donald Lawson Runyon, Duluth, GA (US)

(73) Assignee: ViaSat, Inc., Carlsbad, CA (US)

( * ) Notice: Subject to any disclaimer, the term of this patent is extended or adjusted under 35 U.S.C. 154(b) by 692 days.

(21) Appl. No.: 12/758,914

(22) Filed: Apr. 13, 2010

(65) Prior Publication Data

US 2010/0259346 A1 Oct. 14, 2010

Related U.S. Application Data

(60) Provisional application No. 61/259,053, filed on Nov. 6, 2009, provisional application No. 61/259,047, filed on Nov. 6, 2009, provisional application No. 61/259,049, filed on Nov. 6, 2009, provisional application No. 61/168,913, filed on Apr. 13, 2009, provisional application No. 61/237,967, filed on Aug. 28, 2009, provisional application No. 61/259,375, filed on Nov. 9, 2009, provisional application No. 61/234,513, filed on Aug. 17, 2009, provisional application No. 61/222,354, filed on Jul. 1, 2009, provisional application No. 61/234,521, filed on Aug. 17, 2009, provisional application No. 61/265,605, filed on Dec. 1, 2009, provisional application No. 61/222,363, filed on Jul. 1, 2009, provisional application No. 61/265,587, filed on Dec. 1, 2009.

(51) Int. Cl.
*H01Q 21/00* (2006.01)

(52) U.S. Cl.
USPC ..... 343/771; 343/753; 343/776; 333/21 A

(58) Field of Classification Search
USPC ..... 343/753, 771, 776; 333/21 A
See application file for complete search history.

(56) References Cited

U.S. PATENT DOCUMENTS

| | | | |
|---|---|---|---|
| 3,119,965 | A | 1/1964 | Phillips |
| 4,857,777 | A | 8/1989 | Altes |
| 4,896,374 | A | 1/1990 | Waugh et al. |
| 4,965,602 | A | 10/1990 | Kahrilas et al. |

(Continued)

FOREIGN PATENT DOCUMENTS

| | | |
|---|---|---|
| EP | 0762660 | 3/1997 |
| EP | 1193861 | 4/2002 |

(Continued)

OTHER PUBLICATIONS

International Search Report and Written Opinion dated Oct. 27, 2010, PCT/US10/030876, 8 pages.

(Continued)

*Primary Examiner* — Tho G Phan
(74) *Attorney, Agent, or Firm* — Snell & Wilmer, LLP

(57) ABSTRACT

The subject of this disclosure may relate generally to systems, devices, and methods using interleaved waveguide elements. Specifically, systems, devices, and methods using a dual-polarized broadband, multi-frequency interleaved waveguide antenna aperture are presented. In one exemplary embodiment, a first plurality of waveguide elements are configured to communicate in a first frequency band. In this exemplary embodiment, a second plurality of waveguide elements are configured to communicate in a second frequency band. In one exemplary embodiment the first plurality of waveguide elements and the second plurality of waveguide elements are integrally coupled to a printed circuit board.

20 Claims, 16 Drawing Sheets

(56) References Cited

U.S. PATENT DOCUMENTS

| | | | | |
|---|---|---|---|---|
| 4,994,773 | A | 2/1991 | Chen et al. | |
| 5,045,822 | A | 9/1991 | Mohwinkel | |
| 5,270,719 | A | 12/1993 | Roth | |
| 5,907,815 | A | 5/1999 | Grimm et al. | |
| 5,942,929 | A | 8/1999 | Aparin | |
| 5,966,049 | A | 10/1999 | Yuen et al. | |
| 6,005,515 | A | 12/1999 | Allen et al. | |
| 6,037,909 | A * | 3/2000 | Cherrette | 343/771 |
| 6,061,553 | A | 5/2000 | Matsuoka et al. | |
| 6,087,999 | A * | 7/2000 | Muhlhauser et al. | 343/753 |
| 6,232,837 | B1 | 5/2001 | Yoo et al. | |
| 6,326,845 | B1 | 12/2001 | Masayuki et al. | |
| 6,512,485 | B2 * | 1/2003 | Luly et al. | 343/781 CA |
| 7,098,859 | B2 | 8/2006 | Shimawaki et al. | |
| 7,215,222 | B2 * | 5/2007 | Baird et al. | 333/137 |
| 7,319,345 | B2 | 1/2008 | Farjad-rad et al. | |
| 7,355,470 | B2 | 4/2008 | Sorrells et al. | |
| 7,378,902 | B2 | 5/2008 | Sorrells et al. | |
| 7,400,193 | B2 | 7/2008 | Wyatt | |
| 7,408,507 | B1 | 8/2008 | Paek et al. | |
| 7,420,423 | B2 | 9/2008 | Lee et al. | |
| 7,421,036 | B2 | 9/2008 | Sorrells et al. | |
| 7,436,370 | B2 | 10/2008 | Blanton | |
| 7,620,129 | B2 | 11/2009 | Sorrells et al. | |
| 7,672,653 | B2 | 3/2010 | Cowley et al. | |
| 7,728,784 | B2 | 6/2010 | Mohamadi | |
| 7,746,764 | B2 | 6/2010 | Rawlins et al. | |
| 7,750,733 | B2 | 7/2010 | Sorrells et al. | |
| 7,755,430 | B2 | 7/2010 | Imagawa | |
| 7,885,682 | B2 | 2/2011 | Sorrells et al. | |
| 7,956,703 | B2 * | 6/2011 | Sanders | 333/135 |
| 8,013,784 | B2 | 9/2011 | Margomenos et al. | |
| 2002/0113648 | A1 | 8/2002 | Masayuki et al. | |
| 2003/0016085 | A1 | 1/2003 | Yamazaki | |
| 2003/0162566 | A1 | 8/2003 | Shapira et al. | |
| 2004/0095190 | A1 | 5/2004 | Klaren | |
| 2004/0121750 | A1 | 6/2004 | Nation | |
| 2004/0229584 | A1 | 11/2004 | Fischer et al. | |
| 2005/0113052 | A1 | 5/2005 | Rabinovich | |
| 2005/0151698 | A1 | 7/2005 | Mohamidi | |
| 2006/0170499 | A1 | 8/2006 | Rahman et al. | |
| 2007/0248186 | A1 | 10/2007 | Sorrells et al. | |
| 2007/0275674 | A1 | 11/2007 | Chien | |
| 2007/0280384 | A1 | 12/2007 | Hidaka | |
| 2008/0129408 | A1 | 6/2008 | Nagaishi et al. | |
| 2008/0129634 | A1 | 6/2008 | Pera et al. | |
| 2008/0218424 | A1 | 9/2008 | Blanton | |
| 2009/0086851 | A1 | 4/2009 | Rofougaran | |
| 2009/0091384 | A1 | 4/2009 | Sorrells et al. | |
| 2010/0039174 | A1 | 2/2010 | Teetzel | |
| 2010/0073085 | A1 | 3/2010 | Sorrells et al. | |
| 2010/0097138 | A1 | 4/2010 | Sorrells et al. | |
| 2010/0225389 | A1 | 9/2010 | Teetzel | |
| 2010/0321107 | A1 | 12/2010 | Honcharenko | |

FOREIGN PATENT DOCUMENTS

| | | |
|---|---|---|
| JP | 2003168938 | 6/2003 |
| WO | WO9945609 | 8/1999 |
| WO | WO0003456 | 1/2000 |
| WO | WO0241442 | 5/2002 |
| WO | WO03036756 | 5/2003 |

OTHER PUBLICATIONS

International Search Report and Written Opinion dated Nov. 18, 2010, PCT/US10/30871, 10 pages.
International Search Report and Written Opinion dated Nov. 26, 2010, PCT/US10/30868, 10 pages.
International Search Report and Written Opinion dated Nov. 26, 2010, PCT/US10/30877, 10 pages.
Tokumitsu et al. - Active isolator, combiner, divider and magic-T as miniaturized function blocks dated Nov. 6, 1998.
International Search Report and Written Opinion dated Nov. 26, 2010, PCT/US10/30866, 8 pages.
Aminghasem Safarian et al., Distributed Active Power Combiners and Splitters for Multi-Antenna UWB.
Viallon et al. An Original SiGe Active Differential Output Power Splitter for Millimetre-wave Applications, 2003.
International Search Report and Written Opinion dated Nov. 26, 2010, PCT/US10/30892, 9 pages.
International Search Report and Written Opinion dated Nov. 26, 2010, PCT/US10/30872, 9 pages.
Hsiao Analysis of Interleaved Arrays of Nov. 1971.
International Search Report and Written Opinion dated Nov. 30, 2010, PCT/US10/30906, 11 pages.
Notice of Allowance dated Aug. 14, 2012 in U.S. Appl. No. 12/759,123.
Notice of Allowance dated Aug. 20, 2012 in U.S. Appl. No. 12/759,148.
Office Action dated Aug. 21, 2012 in U.S. Appl. No. 12/759,113.
Final Office Action dated Sep. 17, 2012 in U.S. Appl. No. 12/759,043.
Office Action dated Feb. 27, 2012 in U.S. Appl. No. 12/759,130.
Notice of Allowance dated Feb. 28, 2012 in U.S. Appl. No. 12/759,059.
Office Action dated May 7, 2012 in U.S. Appl. No. 12/759,113.
Aminghasem Safarian et al., "Distributed Active Power Combiners and Splitters for Multi-Antenna UWB Transceivers" Sep. 2006, pp. 138-141.
Office Action dated Aug. 2, 2012 in U.S. Appl. No. 12/758,996.
Notice of Allowance dated May 10, 2012 in U.S. Appl. No. 12/759,130.
Office Action dated May 17, 2012 in U.S. Appl. No. 12/759,043.
Supplemental Notice of Allowability dated May 29, 2012 in U.S. Appl. No. 12/759,130.
Office Action dated May 29, 2012 in U.S. Appl. No. 12/759,123.
Final Office Action dated Jun. 5, 2012 in U.S. Appl. No. 12/759,148.
Supplemental Notice of Allowability dated Jun. 11, 2012 in U.S. Appl. No. 12/759,130.
International Search Report and Written Opinion dated Jul. 19, 2010,PCT US10/030881, 149 pages.
International Search Report and Written Opinion dated Aug. 23, 2010, PCT/US2010/30864,12 pages.
Kwang-Jin, Koh, Gabriel M. Rebeiz, 0.13-mu m CMOS phase shifters for X-, Ku, and K-band phased arrays, IEEE Journal of Solid State Circuits, 2007, 14 pages.
Kwang-Jin, Koh, Jason W. May, Gabriel M. Rebeiz A Q-Band (40-45 GHz) 16-Element Phased-Array Transmitter in 0.18-μm SiGe BiCMOS Technology, IEEE Radio Frequency Integrated Circuits Symposium, 2008, 4 pages.
Kwang-Jin, Koh, Gabriel M. Rebeiz, An X- and Ku-Band 8-Element Phased-Array Receiver in 0.18-μm SiGe BiCMOS Technology, IEEE Journal of Solid State Circuits, Jun. 2008, 12 pages.
International Preliminary Report on Patentability dated Jul. 21, 2011 from PCT/US2010/030877.
International Preliminary Report on Patentability dated Jul. 21, 2011 from PCT/US10/30906.
International Preliminary Report on Patentability dated Jul. 21, 2011 from PCT/US10/30892.
Office Action dated Sep. 29, 2011 from U.S. Appl. No. 12/759,059.
Office Action dated Jan. 4, 2012 from U.S. Appl. No. 12/759,148.
Notice of Allowance dated Jul. 27, 2011 in U.S. Appl. No. 12/759,064.
International Preliminary Report dated Oct. 27, 2011 from PCT/US10/030864.
International Preliminary Report dated Oct. 27, 2011 from PCT/US10/30868.
International Preliminary Report dated Oct. 27, 2011 from PCT/US10/030881.
International Preliminary Report dated Oct. 27, 2011 from PCT/US10/30872.
International Preliminary Report dated Oct. 27, 2011 from PCT/US10/30871.
International Preliminary Report dated Oct. 27, 2011 from PCT/US10/30866.

(56) References Cited

OTHER PUBLICATIONS

International Preliminary Report dated Oct. 27, 2011 from PCT/US10/030876.
USPTO; Office Action dated Apr. 7, 2011 in U.S. Appl. No. 12/759,064.
Zheng et al., "Full 360 degree Vector-Sum Phase-Shifter for Microwave System Applications," IEEE Transactions on Circuits and Systems I: Regular Papers, Downloaded on Jul. 8, 2009, pp. 1-7.
Ayari et al., "Automatic Test Vector Generation for Mixed-Signal Circuits," 1995, Ecole Polytechnique of the University of Montreal, 6 pages.
Strassberg, Dan, "RF-vector-signal generator combines high throughput, low phase noise," EDN, Oct. 6, 2009, 2 pages, UBM Electronics.
Office Action dated Feb. 20, 2013 in U.S. Appl. No. 13/412,901.
Notice of Allowance dated Nov. 8, 2012 in U.S. Appl. No. 12/759,043.
Notice of Allowance dated Dec. 6, 2012 in U.S. Appl. No. 13/540,394.
Notice of Allowance dated Dec. 21, 2012 in U.S. Appl. No. 12/759,113.
Notice of Allowance dated Jan. 30, 2013 in U.S. Appl. No. 12/758,996.
Office Action dated Jul. 10, 2013 in U.S. Appl. No. 13/306,503.
Office Action dated Jul. 9, 2013 in U.S. Appl. No. 13/306,937.
Notice of Allowance dated Aug. 29, 2013 in U.S. Appl. No. 13/412,901.
Notice of Allowance dated Sep. 3, 2013 in U.S. Appl. No. 13/692,683.
Office Action dated Sep. 6, 2013 in U.S. Appl. No. 12/759,112.
Office Action dated Sep. 24, 2013 in U.S. Appl. No. 13/771,884.

* cited by examiner

Distribution Pattern

Practical Distribution Illustration

DUAL-POLARIZED MULTI-BAND, FULL DUPLEX, INTERLEAVED WAVEGUIDE ANTENNA APERTURE

CROSS REFERENCE TO RELATED APPLICATIONS

This application is a non-provisional of U.S. Provisional Application No. 61/259,053, entitled "ELECTROMECHANICAL POLARIZATION SWITCH," which was filed on Nov. 6, 2009. This application is also a non-provisional of U.S. Provisional Application No. 61/259,047, entitled "AUTOMATED BEAM PEAKING SATELLITE GROUND TERMINAL," which was filed on Nov. 6, 2009. This application is a non-provisional of U.S. Provisional Application No. 61/259,049, entitled "DYNAMIC REAL-TIME POLARIZATION FOR ANTENNAS," which was filed on Nov. 6, 2009. This application is a non-provisional of U.S. Provisional Application No. 61/168,913, entitled "ACTIVE COMPONENT PHASED ARRAY ANTENNA," which was filed on Apr. 13, 2009. This application is a non-provisional of U.S. Provisional Application No. 61/237,967, entitled "ACTIVE BUTLER AND BLASS MATRICES," which was filed on Aug. 28, 2009. This application is also a non-provisional of U.S. Provisional Application No. 61/259,375, entitled "ACTIVE HYBRIDS FOR ANTENNA SYSTEMS," which was filed on Nov. 9, 2009. This application is a non-provisional of U.S. Provisional Application No. 61/234,513, entitled "ACTIVE FEED FORWARD AMPLIFIER," which was filed on Aug. 17, 2009. This application is a non-provisional of U.S. Provisional Application No. 61/222,354, entitled "ACTIVE PHASED ARRAY ARCHITECTURE," which was filed on Jul. 1, 2009. This application is a non-provisional of U.S. Provisional Application No. 61/234,521, entitled "MULTI-BAND MULTI-BEAM PHASED ARRAY ARCHITECTURE," which was filed on Aug. 17, 2009. This application is a non-provisional of U.S. Provisional Application No. 61/265,605, entitled "HALF-DUPLEX PHASED ARRAY ANTENNA SYSTEM," which was filed on Dec. 1, 2009. This application is a non-provisional of U.S. Provisional Application No. 61/222,363, entitled "BIDIRECTIONAL ANTENNA POLARIZER," which was filed on Jul. 1, 2009. This application is a non-provisional of U.S. Provisional Application No. 61/265,587, entitled "FRAGMENTED APERTURE FOR THE KA/K/KU FREQUENCY BANDS," which was filed on Dec. 1, 2009. All of the contents of the previously identified applications are hereby incorporated by reference for any purpose in their entirety.

FIELD

The subject of this disclosure may relate generally to systems, devices, and methods using interleaved waveguide elements. Specifically, systems, devices, and methods using a dual-polarized, broadband, multi-frequency, interleaved waveguide antenna aperture for communicating RF signals is presented.

BACKGROUND

A phased array antenna uses multiple radiating elements to transmit, receive, or transmit and receive radio frequency (RF) signals. Phased array antennas may be used in various capacities, including communications on the move (COTM) antennas, communications on the pause (COTP) antennas, satellite communication (SATCOM) airborne terminals, SATCOM mobile communications, Local Multipoint Distribution Service (LMDS), wireless point to point (PTP) microwave systems, and SATCOM earth terminals. Furthermore, the typical components in a phased array antenna are distributed components that are therefore frequency sensitive and designed for specific frequency bands.

In a typical prior art embodiment, a phased array antenna comprises a radiating element that communicates dual linear signals to a hybrid coupler with either a 90° or a 180° phase shift and then through low noise amplifiers (LNA). Furthermore, the dual linear signals are adjusted by phase shifters before passing through a power combiner.

In a typical prior art embodiment, separate transmit and receive arrays are required which, while located in close proximity, fail to provide co-located beams for the transmit and receive bands of operation.

Thus, a need exists for a phased array antenna architecture that is not frequency limited or polarization specific. Furthermore, the antenna architecture should allow for both transmit and receive communication with substantially co-located beams.

SUMMARY

In accordance with various exemplary embodiments, a system including (1) a first plurality of waveguide elements; and (2) a second plurality of waveguide elements interleaved in a housing with the first plurality of waveguide elements is disclosed. In this exemplary embodiment, the first plurality of waveguide elements may be configured to communicate in a first frequency band. In this exemplary embodiment, the second plurality of waveguide elements may be configured to communicate in a second frequency band. In this exemplary embodiment, the first plurality of waveguide elements and the second plurality of waveguide elements may be integrally coupled to a printed circuit board. Additionally, in this exemplary embodiment, the system may be capable of full duplex operation.

In accordance with various exemplary embodiments, a method for communicating RF signals includes (1) transmitting a first signal via a first plurality of waveguide elements; and (2) receiving a second signal via a second plurality of waveguide elements interleaved with the first plurality of waveguide elements in a housing is disclosed. In this exemplary embodiment, the first plurality of waveguide elements may be configured to communicate in a first frequency band. In this exemplary embodiment, the second plurality of waveguide elements may be configured to communicate in a second frequency band. In this exemplary embodiment, the first plurality of waveguide elements and the second plurality of waveguide elements may be integrally coupled to a printed circuit board. In this exemplary embodiment the RF signals may be communicated in full duplex operation.

BRIEF DESCRIPTION OF THE DRAWINGS

These and other features, aspects and advantages of the present invention will become better understood with reference to the following description, appending claims, and accompanying drawings where:

DETAILED DESCRIPTION

Figure 1A:
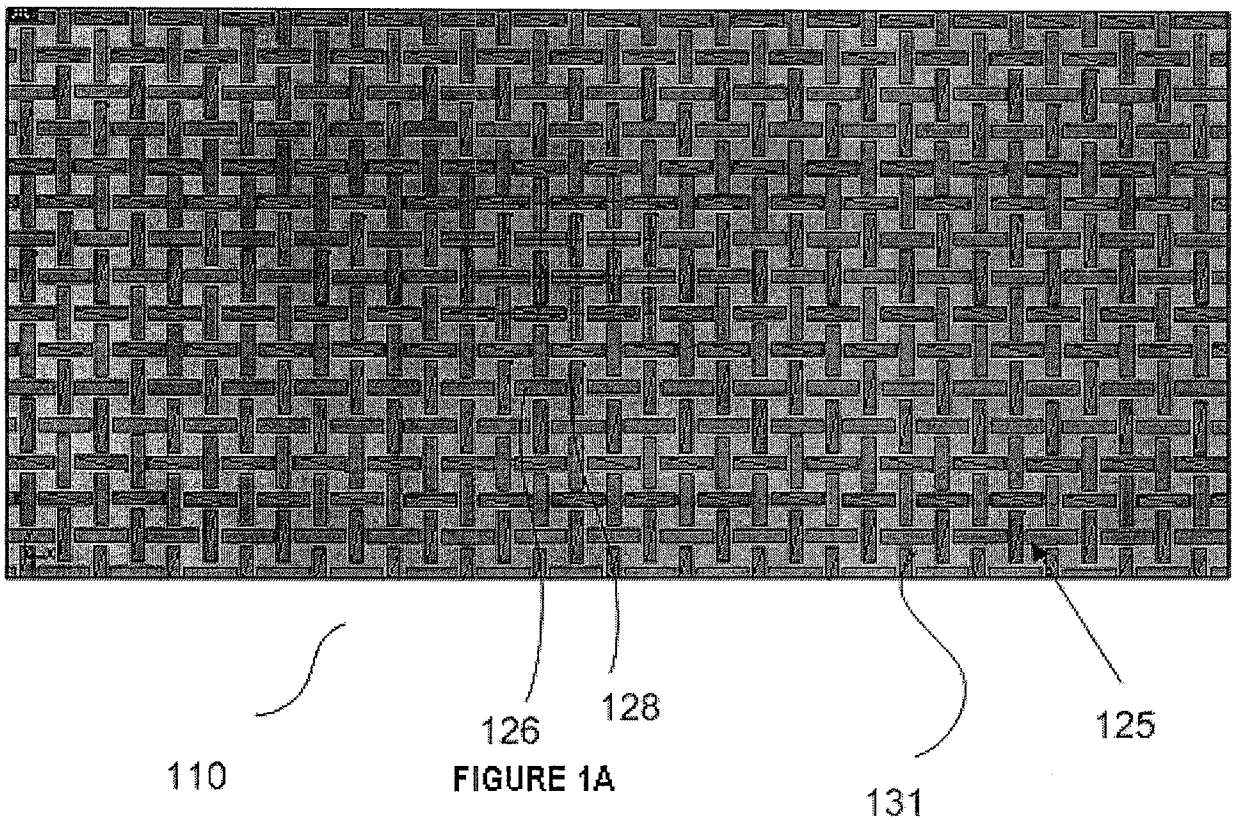
FIG. 1A illustrates an exemplary front view of a phased array device.

In accordance with an exemplary embodiment of the present invention, systems, devices, and methods are provided, for among other things, facilitating improved communication of RF signals. The following descriptions are not intended as a limitation on the use or applicability of the systems herein, but instead, are provided merely to enable a full and complete description of exemplary embodiments.

Active splitter: In an exemplary embodiment, an active power splitter comprises a differential input subcircuit, a first differential output subcircuit, and a second differential output subcircuit. The differential input subcircuit has paired transistors with a common emitter node and is constant current biased, as is typical in a differential amplifier. An input signal is communicated to the base of paired transistors in the differential input subcircuit. Both the first and second differential output subcircuits comprise a pair of transistors with a common base node and each common base is connected to ground.

The first differential output subcircuit has a first transistor emitter connected to the collector of one of the input subcircuit transistors. The emitter of the second output subcircuit transistor is connected to the collector of the other input subcircuit transistor. In the exemplary embodiment, the first output is drawn from the collectors of transistors of the first differential output subcircuit. Furthermore, the second differential output subcircuit is similarly connected, except the transistor emitters are inversely connected to the input subcircuit transistor collectors with respect to the transistors.

By inverting the input subcircuit transistor collector connections between the first and second differential output subcircuits, the first output and the second output are approximately 180° out of phase with each other. In another exemplary embodiment, the transistor emitters are non-inversely connected to the input subcircuit transistor collectors, causing the first output and the second output to be approximately in phase with each other. In general, the absolute phase shift of the output signals through the power splitter is not as important as the relative phasing between the first and second output signals.

In an exemplary embodiment, an active power splitter converts an input RF signal into two output signals. The output signal levels may be equal in amplitude, though this is not required. For a prior art passive power splitter, each output signal would be about 3 dB lower in power than the input signal. In contrast, an exemplary active splitter can provide gain and the relative power level between the input signal and the output signal is adjustable and can be selectively designed. In an exemplary embodiment, the output signal is configured to achieve a substantially neutral or positive power gain over the input signal. For example, the output signal may be configured to achieve a 3 dB signal power gain over the input signal. In an exemplary embodiment, the output signal may achieve a power gain in the 0 dB to 5 dB range. Moreover, the output signal may be configured to achieve any suitable power gain.

In accordance with an exemplary embodiment, an active power splitter produces output signals with a differential phase between the two signals that is zero or substantially zero. The absolute phase shift of output signals through the active power splitter may not be as important as the differential phasing between the output signals.

In another exemplary embodiment, an active power splitter additionally provides matched impedances at the input and output ports. The matched impedances may be 50 ohms, 75 ohms, or other suitable impedances. Furthermore, in an exemplary embodiment, an active splitter provides isolation between the output ports of the active power splitter. In one exemplary embodiment, an active power splitter is manufactured as a radio frequency integrated circuit (RFIC) with a compact size that is independent of the operating frequency due to a lack of distributed components.

Active Combiner: In an exemplary embodiment an active power combiner comprises a first differential input subcircuit, a second differential input subcircuit, a single ended output subcircuit, and a differential output subcircuit. Each differential input subcircuit includes two pairs of transistors, with each transistor of each differential input subcircuit having a common emitter node with constant current biasing, as is typical in a differential amplifier.

A first input signal is communicated to the bases of the transistors in first differential input subcircuit. For example, a first line of input signal In1 is provided to one transistor of each transistor pair in first differential input subcircuit, and a second line of input signal In1 is provided to the other transistor of each transistor pair. Similarly, a second input signal is communicated to the bases of the transistors in second differential input subcircuit. For example, a first line of input signal In2 is provided to one transistor of each transistor pair in first differential input subcircuit, and a second line of input signal In2 is provided to the other transistor of each transistor pair. Furthermore, in an exemplary embodiment, a differential output signal is formed by a combination of signals from collectors of transistors in first and second differential input subcircuits.

In an exemplary embodiment, active power combiner converts two input RF signals into a single output signal. The output signal can either be a single ended output at a single ended output subcircuit, or a differential output at a differential output subcircuit. In other words, an active power combiner performs a function that is the inverse of active power splitter. The input signal levels can be of arbitrary amplitude and phase. Similar to an active power splitter, an active power combiner can provide gain and the relative power level between the inputs and output is also adjustable and can be selectively designed. In an exemplary embodiment, the output signal achieves a substantially neutral or positive signal power gain over the input signal. For example, the output signal may achieve a 3 dB power gain over the sum of the input signals. In an exemplary embodiment, the output signal may achieve a power gain in the 0 dB to 5 dB range. Moreover, the output signal may achieve any suitable power gain.

In another exemplary embodiment, an active power splitter additionally provides matched impedances at the input and output ports. The matched impedances may be 50 ohms, 75 ohms, or other suitable impedances. Furthermore, in an exemplary embodiment, an active splitter provides isolation between the output ports of the active power splitter. In one exemplary embodiment, the active power splitter is manufactured as a RFIC with a compact size that is independent of the operating frequency due to a lack of distributed components Vector Generator: In an exemplary embodiment, a vector generator converts an RF input signal into an output signal (sometimes referred to as an output vector) that is shifted in phase and/or amplitude to a desired level. This replaces the function of a typical phase shifter and adds the capability of amplitude control. In other words, a vector generator is a magnitude and phase control circuit. In the exemplary embodiment, the vector generator accomplishes this function by feeding the RF input signal into a quadrature network resulting in two output signals that differ in phase by about 90°. The two output signals are fed into parallel quadrant select circuits, and then through parallel variable gain amplifiers (VGAs). In an exemplary embodiment, the quadrant select circuits receive commands and may be configured to either pass the output signals with no additional relative phase shift between them or invert either or both of the output signals by an additional 180°. In this fashion, all four possible quadrants of the 360° continuum are available to both orthogonal signals. The resulting composite output signals from the current summer are modulated in at least one of amplitude and phase.

In accordance with an exemplary embodiment a vector generator comprises a passive I/Q generator, a first variable gain amplifier (VGA) and a second VGA, a first quadrant select and a second quadrant select each configured for phase inversion switching, and a current summer. The first quadrant select is in communication with I/Q generator and first VGA. The second quadrant select is in communication with the I/Q generator and the second VGA. Furthermore, in an exemplary embodiment, a vector generator comprises a digital controller that controls a first digital-to-analog converter (DAC) and a second DAC. The first and second DACs control first and second VGAs, respectively. Additionally, a digital controller controls first and second quadrant selects.

In an exemplary embodiment, a vector generator controls the phase and amplitude of an RF signal by splitting the RF signal into two separate vectors, the in-phase (I) vector and the quadrature-phase (Q) vector. In one embodiment, the RF signal is communicated differentially. The differential RF signal communication may be throughout the vector generator or limited to various portions of the vector generator. In another exemplary embodiment, the RF signals are communicated non-differentially. The I vector and Q vector are processed in parallel, each passing through the phase inverting switching performed by first and second quadrant selects. The resultant outputs of the phase inverting switches comprise four possible signals: a non-inverted I, an inverted I, a non-inverted Q, and an inverted Q. In this manner, all four quadrants of a phasor diagram are available for further processing by VGAs. In an exemplary embodiment, two of the four possible signals non-inverted I, inverted I, non-inverted Q, and inverted Q are processed respectively through VGAs, until the two selected signals are combined in a current summer to form a composite RF signal. The current summer outputs the composite RF signal with phase and amplitude adjustments. In an exemplary embodiment, the composite RF signal is in differential signal form. In another exemplary embodiment, the composite RF signals are in single-ended form.

In an exemplary embodiment, control for the quadrant shifting and VGA functions is provided by a pair of DACs. In an exemplary embodiment, reconfiguration of a digital controller allows the number of phase bits to be digitally controlled after a vector generator is fabricated if adequate DAC resolution and automatic gain control (AGC) dynamic range exists. In an exemplary embodiment with adequate DAC resolution and AGC dynamic range, any desired vector phase and amplitude can be produced with selectable fine quantization steps using digital control. In another exemplary embodiment, reconfiguration of DACs can be made after a vector generator is fabricated in order to facilitate adjustment of the vector amplitudes.

In another exemplary embodiment, the antenna system architecture may support half-duplex and/or full-duplex operation. In one exemplary embodiment with reference to FIG. 3, the antenna system may further comprise a printed circuit board containing a plurality of radiating elements in a layered structure; the layered structure comprising a driven layer and at least one parasitic layer. The printed circuit board radiating element may be configured to function as an antenna. In yet another exemplary embodiment, the antenna system may support operation over substantially simultaneous multiple frequency bands. In one exemplary embodiment, the waveguide aperture phased array antenna system may have full electronic polarization agility. In another exemplary embodiment, the waveguide aperture phased array antenna architecture may support multiple simultaneous beams.

In one exemplary embodiment, a RF control module may include a vector control device. In an exemplary embodiment, the vector control device is not comprised of a separate phase shifter and attenuator but instead is a single entity, such as a vector generator. Phase and amplitude may be controlled for each basis polarization of each radiating element.

In accordance with an exemplary embodiment, a phased array may include a planar array of waveguide radiators coupled to waveguide apertures (waveguide elements). In one exemplary embodiment, waveguide elements may include transmit waveguide apertures and receive waveguide apertures arranged in any suitable configuration. For instance, in one exemplary embodiment the phased array may include interleaved transmit waveguide apertures and receive waveguide apertures.

Figure 1B:
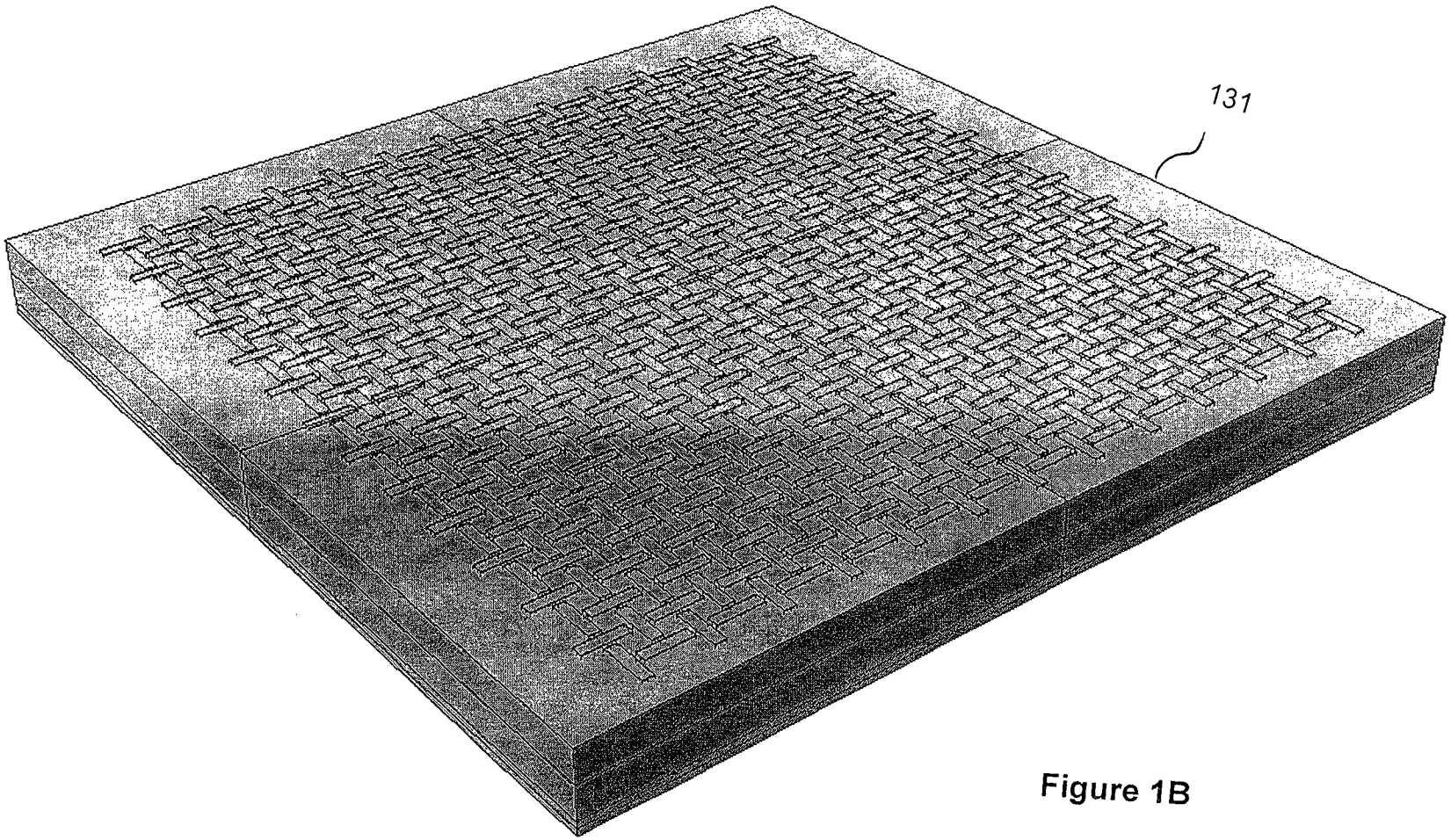
FIG. 1B illustrates an exemplary unitary waveguide assembly coupled to a multilayer printed circuit board.
Figure 1C:
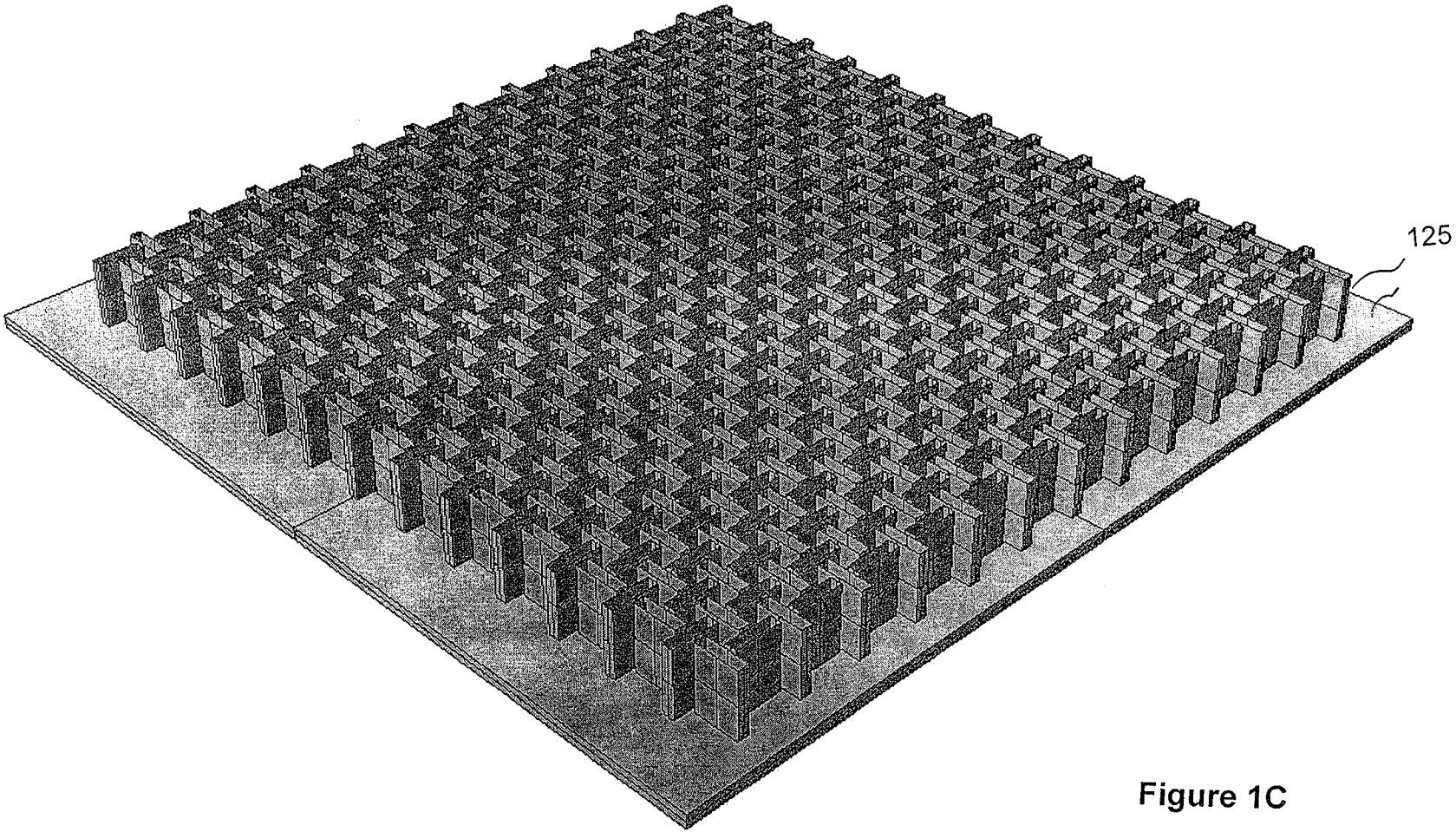
FIG. 1C illustrates apertures formed from the exemplary unitary waveguide assembly of FIG. 1B coupled to a multilayer printed circuit board.
Figure 1D:
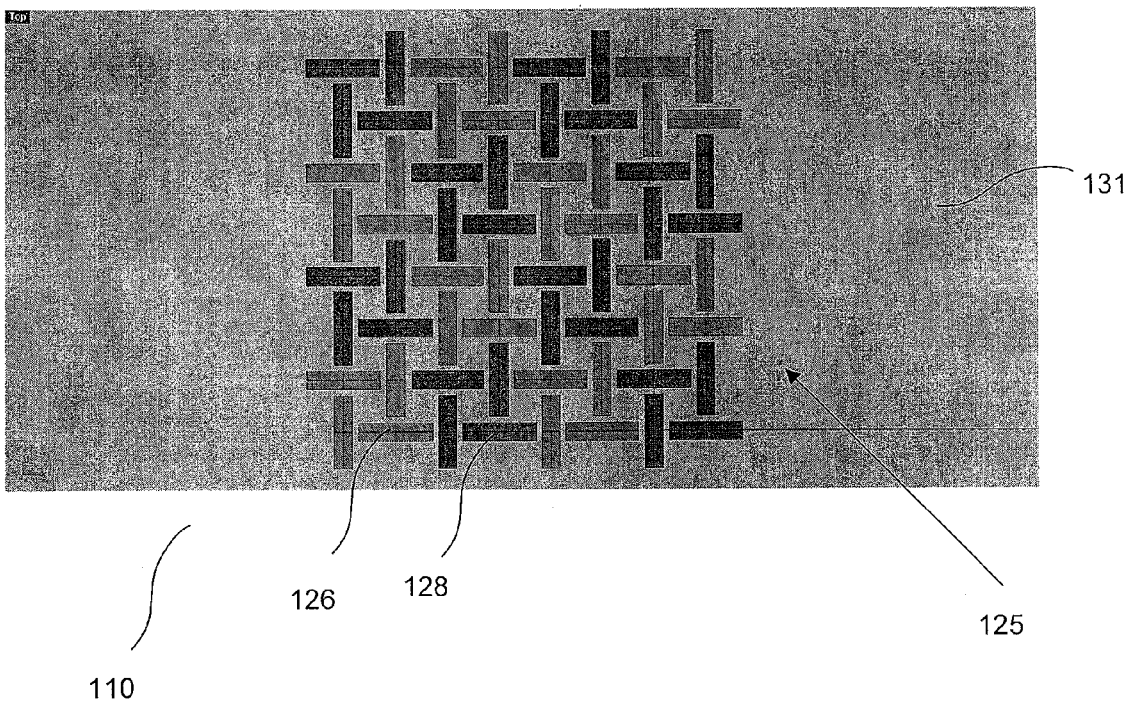
FIG. 1D illustrates an exemplary zoomed in view of the exemplary phased array topology of FIG. 1A.

In one exemplary embodiment with reference to FIGS. 1A & 1D, a phased array 110 comprises a plurality of waveguide apertures 125. Waveguide apertures 125 may be formed, for example, in an aperture plate 131. In an exemplary embodiment, waveguide apertures 125 comprise transmit waveguide apertures 126 and receive waveguide apertures 128.

Although waveguide apertures 125 may be formed using any suitable materials, in any suitable shape and manner, in one exemplary embodiment waveguide apertures 125 is formed in an aperture plate 131. In one exemplary embodiment, aperture plate 131 may be made by any desired technique, such as, for instance, machined, wire EDM, cast or molded. For instance, in one exemplary embodiment and with reference to FIGS. 1B and 1C an aperture plate 131 is formed from a monolithic material. FIG. 1C illustrates waveguides formed in the monolithic aperture plate 131. In this exemplary embodiment, the aperture plate is integrally coupled to a multilayer printed circuit board. In one exemplary embodiment, aperture plate 131 may be made from any suitable materials having a conducting surface layer of sufficient thickness at the operational frequency bands to perform as a radio frequency ground layer, such as, for instance, metal, ferromagnetic material, metalized plastic and/or the like.

In accordance with an exemplary embodiment, transmit waveguide aperture 126 and receive waveguide aperture 128 may each comprise a pair of orthogonal waveguides. For instance, a pair may be more than one transmit waveguide aperture 126 or more than one receive waveguide aperture 128. Each waveguide aperture 125 may have length and a width, wherein the length may be a longer measurable dimension than a measurable dimension of the width, such as a rectangle. One of the plurality of transmit waveguide apertures 125 may be oriented in a first direction, such as with a length in a substantially horizontal orientation, and a second transmit waveguide aperture 126 in a second direction, such as with a length in a substantially vertical orientation. In this exemplary embodiment, these waveguide apertures 125 may comprise an orthogonal pair. In one exemplary embodiment, an orthogonal pair of waveguide apertures 125 may form a "T" shape in any suitable orientation. In one exemplary embodiment, an orthogonal pair of waveguide apertures 125 may form an "L" shape in any suitable orientation or a backwards "L" shape in any suitable orientation. In another exemplary embodiment the first waveguide aperture 126 of a plurality of waveguide apertures 126 may be oriented in any suitable location along an orthogonal plane with respect to a second waveguide aperture 126 of a plurality of waveguide apertures 126.

In accordance with an exemplary embodiment, transmit waveguide apertures 126 and receive waveguide apertures 128 are interleaved. For instance, in accordance with an exemplary embodiment, at least a portion of an orthogonal pair of a receive waveguide apertures 128 may be interposed, in close proximity, between at least a portion of a plurality of orthogonal pairs of transmit waveguide apertures 126. Similarly, in accordance with this exemplary embodiment, at least a portion of an orthogonal pair of transmit waveguide apertures 126 may be interposed, in close proximity, between at least a portion of orthogonal pairs of a plurality of receive waveguide apertures 128. In accordance with an exemplary embodiment, the topology of a lattice of waveguide apertures 126 shall be configures such that spaces between orthogonal pairs of waveguide apertures 126 shall be filled portions of other orthogonal pairs of transmit waveguides 126.

In accordance with an exemplary embodiment at least a portion of a receive waveguide aperture 128 may be interposed, in close proximity, between at least a portion of a plurality of transmit waveguide apertures 126. Similarly, in accordance with this exemplary embodiment, at least a portion of a transmit waveguide aperture 126 may be interposed, in close proximity, between at least a portion of a plurality of receive waveguide apertures 128.

Stated another way, in one exemplary embodiment, a plurality of transmit waveguide apertures 126 may be arranged within a boundary and a plurality of receive waveguide apertures 128 shall be overlapping arranged within the same boundary. In one exemplary embodiment, the overlap is substantially 100%. In another exemplary embodiment, the overlap is less than 100%. In one exemplary embodiment, the percentage of overlap is as high as possible. In one exemplary embodiment, the waveguide apertures 125 may be arranged within a boundary in a regular pattern. In one exemplary embodiment, the waveguide apertures 125 may be arranged within a boundary in an irregular pattern. In one exemplary embodiment, the waveguide apertures 125 may be arranged within a boundary as a combination of a portion of a regular pattern and of a portion of an irregular pattern. In one exemplary embodiment, the waveguide apertures 125 may be oriented in a first direction, such as with a length in a substantially horizontal orientation, and a second waveguide aperture 126 in a second direction, such as with a length in a substantially vertical orientation in a fixed local coordinate system relative to a boundary. In one exemplary embodiment, the waveguide apertures 125 may be oriented in a first direction, such as with a length in a substantially slant 45° orientation, and a second waveguide aperture 126 in a second direction orthogonal to the first, such as with a length in a substantially slant −45° orientation in a fixed local coordinate system relative to a boundary. In one exemplary embodiment, the waveguide apertures 125 may be oriented in a first direction, such as with a length in a substantially orientation angle $\alpha$, and a second waveguide aperture 126 in a second direction orthogonal to the first direction, such as with a length in a substantially orientation angle $\alpha+90°$ in a fixed local coordinate system relative to a boundary.

In accordance with an exemplary embodiment, interleaved transmit waveguide apertures 126 and receive waveguide apertures 128 may be orthogonal pairs of transmit waveguide apertures 126 and receive waveguide apertures 128. In one exemplary embodiment with reference to FIG. 1B, these orthogonal pairs of transmit waveguide apertures 126 and receive waveguide apertures 128 may be configured in any suitable orientation. For instance, the orthogonal pair may be rotated together and oriented at any suitable angle. In an exemplary embodiment, the orthogonal pair may be rotated together and grouped with other orthogonal pairs of like or different rotation angles relative to a reference coordinate system. A plurality of groups of pairs may be oriented at any angle relative to a reference coordinate system. For instance, in one exemplary embodiment, these orthogonal pairs of transmit waveguide apertures 126 and receive waveguide apertures 128 may be configured with orthogonal phase weights leading to sequential rotation circular polarization generation. An orthogonal pair of radiating elements may have substantially equal amplitude weights and a 0° and a ±90° phase relationship within the pair. In an exemplary embodiment, the resulting electric field radiated from the pair will be circularly polarized. In another exemplary embodiment, these orthogonal pairs of transmit waveguide apertures 126 and receive waveguide apertures 128 may be configured with equal amplitude weights and substantially orthogonal phase weights as (0°, +90°) in the transmit pair and (0°, −90°) in the receive pair leading to sequential orthogonal circular polarization generation for transmit and receive modes of operation. In another exemplary embodiment, these orthogonal pairs of transmit waveguide apertures 126 and receive waveguide apertures 128 may be configured with equal amplitude weights and substantially equal phase weights as (0°, 0°) in the transmit pair and opposite phase (0°, 180°) in the receive pair leading to orthogonal linear polarization generation for transmit and receive modes of operation.

In one exemplary embodiment, the pairs of transmit waveguide apertures 126 and receive waveguide apertures 128 may be orthogonal in regions of close proximity. For instance, in one exemplary embodiment, with separation equal to less than the 15% length of transmit waveguide apertures 126.

In one exemplary embodiment, waveguide apertures 125 may be any suitable shape, such as, rectangular, rectangular with rounded ends, elliptical, and/or any elongated shape or form, such as a form where the aspect ratio is greater than 1.8 to 1. In one exemplary embodiment, waveguide apertures 125, such as transmit waveguide apertures 126 and receive waveguide apertures 128 may be unequal size. For instance, in one exemplary embodiment, transmit waveguide apertures 126 and receive waveguide apertures 128 may be an unequal size as compared with other transmit waveguide apertures 126 and receive waveguide apertures 128 within the same lattice. Alternatively, transmit waveguide apertures 126 may be unequal size to other transmit waveguide apertures 126 within the same lattice. Also, receive waveguide apertures 128 may be unequal size to other receive waveguide apertures 128 within the same lattice. Alternatively, in one exemplary embodiment, waveguide apertures 125, within a lattice, such as transmit waveguide apertures 126 and receive waveguide apertures 128 may be equal size. In one exemplary embodiment, multiple transmit waveguide apertures 126 and/or receive waveguide apertures 128 may be a combination of equal and unequal size as compared with other transmit waveguide apertures 126 and/or receive waveguide apertures 128 within a lattice.

In one exemplary embodiment, waveguide apertures 125 sizes are proportional to the frequency band they propagate. Waveguide aperture 125 may be any suitable size, width, length and/or aspect ration. In one exemplary embodiment, waveguide apertures are 0.340 inch long and 0.085 inch (i.e. 25% of the waveguide aperture length) wide.

In one exemplary embodiment, waveguide apertures 125 may be configured to filter bands by selecting size and interior features of the waveguide aperture 125. For instance, transmit waveguide apertures 126 may be sized to selectively propagate transmit signals. Stated another way, transmit waveguide apertures 126 may be sized to filter signals other than transmit signals. For instance, transmit waveguide apertures 126 may be shaped and sized to reject high power amplifier noise that would otherwise appear in the receive band. Alternatively, in one exemplary embodiment, a high pass filter is coupled to portions of phased array 110 to reject high power amplifier noise that would otherwise appear in the receive band. In one exemplary embodiment, receive waveguide apertures 128 may be sized to selectively reject transmit signals. Alternatively, in one exemplary embodiment, a band pass filter is coupled to portions of phased array 110 to reject frequencies that would otherwise appear as the transmit signal.

Figure 1E:
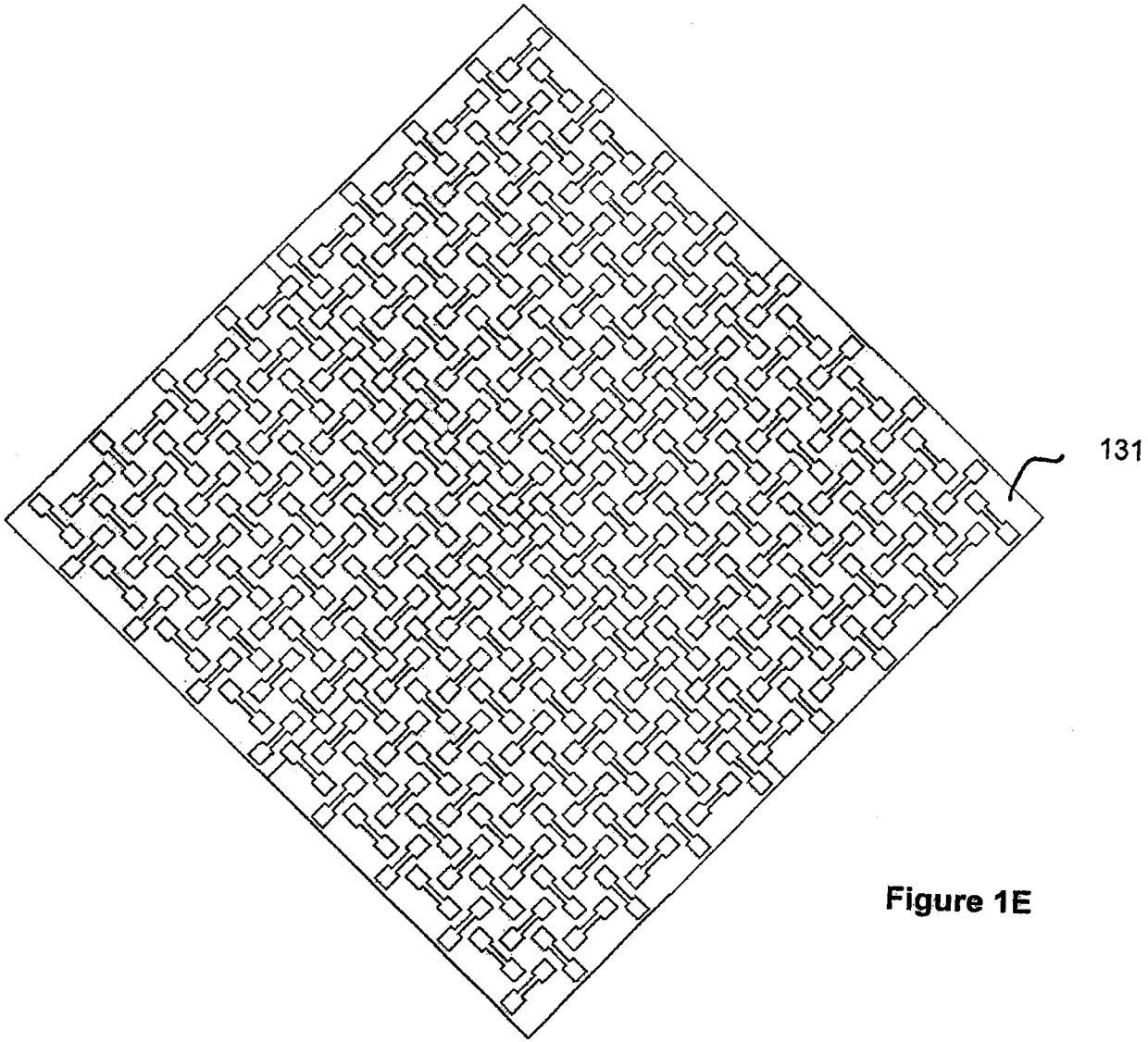
FIG. 1E depicts an exemplary embodiment of a single ridge loaded waveguide aperture.

In one exemplary embodiment with reference to FIG. 1E, waveguide apertures 125 may be configured for wide operating bandwidths using single or dual ridge loading, such as wide operating bandwidths of 2.4:1 bandwidth ratios in the Ku and/or Ka-bands. In one exemplary embodiment, waveguide apertures 125 of phased array 110 may form any suitable lattice, such as, rectangular, triangular, and/or square. In other words, in one embodiment, the waveguide apertures 125 of phased array 110 are located on a grid that may be uniform or non-uniform having unequal spacing in one or two dimensions. In one exemplary embodiment, waveguide apertures 125 of phased array 110 are quasi randomly spaced apart in a manner as a thinned array.

In one exemplary embodiment, the waveguide apertures may have a shape to reduce the fundamental or dominant waveguide mode cutoff frequency value relative to a rectangular waveguide aperture of the same length. A ridge loaded waveguide may be used to reduce the dominant waveguide mode cutoff frequency relative to a rectangular waveguide aperture. In one exemplary embodiment the waveguide apertures are loaded with a single ridge. In an alternate exemplary embodiment the waveguide apertures are loaded with a double ridge arrangement. The single ridge or double ridge may be offset from the center of the waveguide aperture. Furthermore, ridge waveguide apertures may be mixed with non-ridged waveguide apertures within phased array 110. Ridge waveguide apertures may allow smaller radiating elements to be used within phased array 110 and may allow closer spacing of pairs or sets of radiators. In addition, ridge waveguide apertures may allow wider bandwidth operation relative to non-ridge waveguide apertures. In one exemplary embodiment having ridge waveguide apertures the operational bandwidth ratio is 2.4 to 1. In other words, the highest frequency of operation is 2.4 times the lowest frequency of operation.

Figure 3:
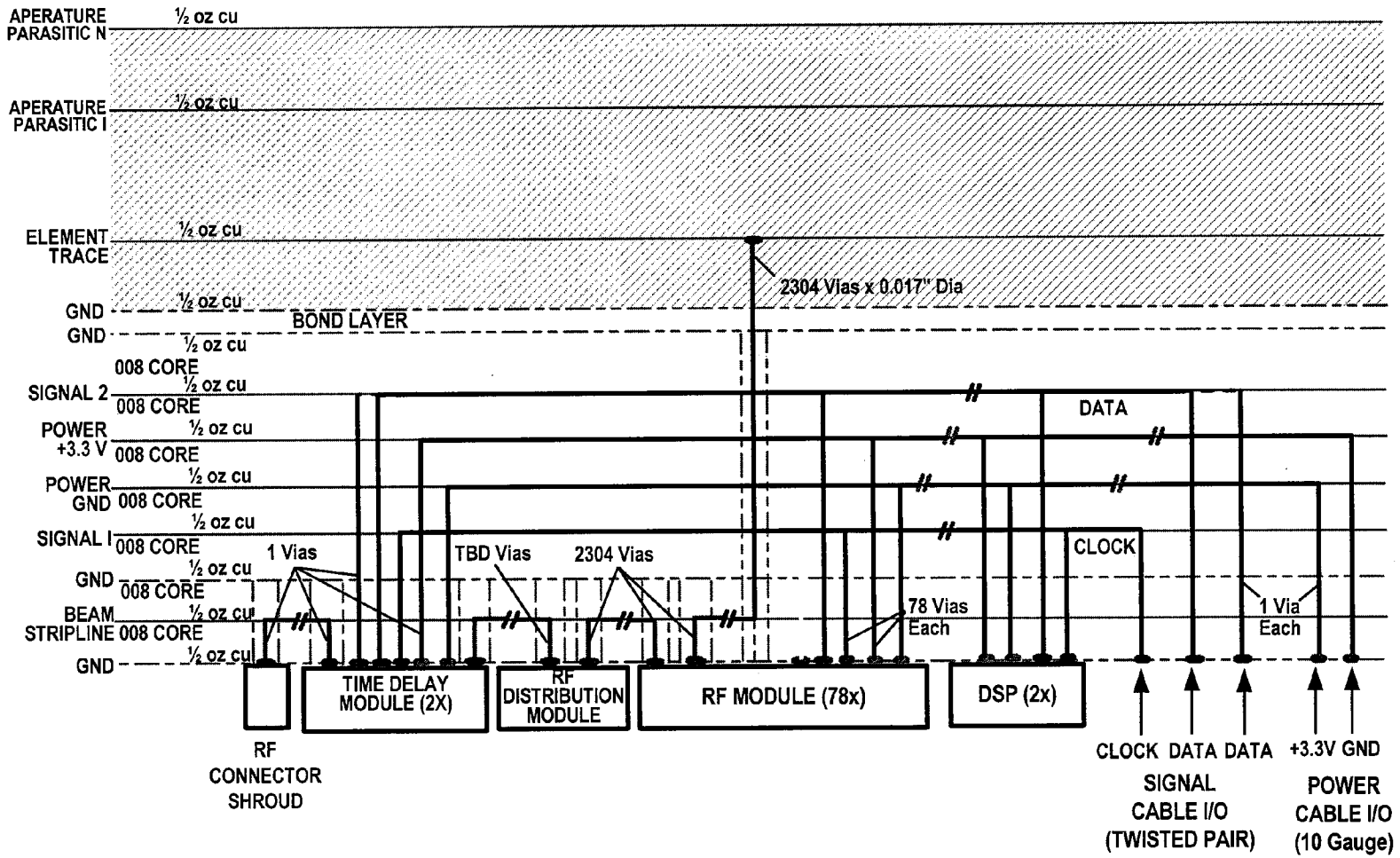
FIG. 3 illustrates and exemplary printed circuit board layout.

In one exemplary embodiment with reference to FIG. 3, a side cut away view of an exemplary waveguide radiator is illustrated. In this exemplary embodiment, the radiating element is integrally coupled to an integrated circuit, such as a MMIC module or a printed circuit board. For instance, rather than a radiating element being coupled to an integrated circuit, the radiating element is fashioned as part of the integrated circuit materials. In one exemplary embodiment, though any material may be used the radiating elements may be fabricated on any suitable MMIC substrate (i.e., chip, die) of a suitable semiconductor material such as silicon (Si), gallium arsenide (GaAs), germanium (Ge), organic polymers, indium phosphide (InP), and combinations such as mixed silicon and germanium (e.g. SiGe), mixed silicon and carbon, or any semiconductor substrate suitable for fabricating radiating elements. In another exemplary embodiment, the antenna system architecture may support half-duplex and/or full duplex operation.

In one exemplary embodiment, the antenna system may further comprise a printed circuit board containing a plurality of radiating elements in a layered structure; the layered structure comprising a driven layer and at least one parasitic layer. The printed circuit board radiating element may be configured to function as an antenna. In yet another exemplary embodiment, the antenna system may support operation over substantially simultaneous multiple frequency bands. In another exemplary embodiment, the antenna system may support dynamic polarization degradation correction.

In an exemplary embodiment, a digital signal processor (DSP) may provide local beam steering calculations and commands for each radiating element. These steering calculations and commands may include I and Q calculations and commands. These steering calculations and commands may include amplitude and phase calculations and commands. The DSP may provide a calculation and/or command to a vector generator for each basis polarization, phase and/or amplitude, for each element. The aggregate of the elements' polarization results in the total polarization of the system. Steering corrections may also be performed by a vector generator located on or off chip. In one exemplary embodiment, these off chip corrections and commands may be communicated to the chip through a serial cable. The DSP may be electrically coupled to one or more time delay modules, RF modules, signal cable input/output, and/or power input/output.

In one exemplary embodiment, with renewed reference to FIG. 3, the RF module communicates bidirectional signals with the radiating element and includes the low noise amplifier (LNA) for receive signals and the RF power amplifier (PA) for transmit signals. In one exemplary embodiment, there is a LNA and a PA corresponding to each basis polarization of a radiating element. The RF module comprises the vector generators for each basis polarization. Vector generators may be separate for transmit and receive or they may be shared by transmit and receive operations. The RF module may be electrically coupled to one or more time delay module, RF distribution module, element trace, DSP, signal input/output and/or power input/output. The RF module may send a signal to the element trace.

The radiating element layer may comprise a radiating element, a dielectric material, such as an aperture parasitic, and a back plane. In one exemplary embodiment, the radiating element layer may comprise one or more element trace, ground couplings, bond layer, aperture parasitic, radio frequency laminate, control power laminate, and/or antenna laminate.

In one exemplary embodiment, the radiating element may comprise any radiating element suitable to function as an antenna. For instance, the radiating element may comprise a printed circuit board integrated radiating element.

In one exemplary embodiment, a radiating element is implemented in at least three conducting layers of a printed circuit board. The first conducting layer acts as a ground plane to the radiating element and the second conducting layer is the driven element and is direct connected to the RF module. A third conducting layer corresponds to a parasitic layer above the driven layer. There may be more than one parasitic layer in the radiating element design depending on the requirements for specific bands and scan performance. In an exemplary embodiment, the radiating elements may be air loaded, dielectrically loaded, or ridge loaded radiators with air or dielectric loading.

Additional systems and methods for broad-band aperture phased array antennas are described in co-pending U.S. Provisional Patent Application Ser. No. 61/265,587, entitled "FRAGMENTED APERTURE FOR THE KA/K/KU FREQUENCY BANDS" filed Dec. 1, 2009 the contents of which are hereby incorporated by reference in their entirety.

Figure 2:
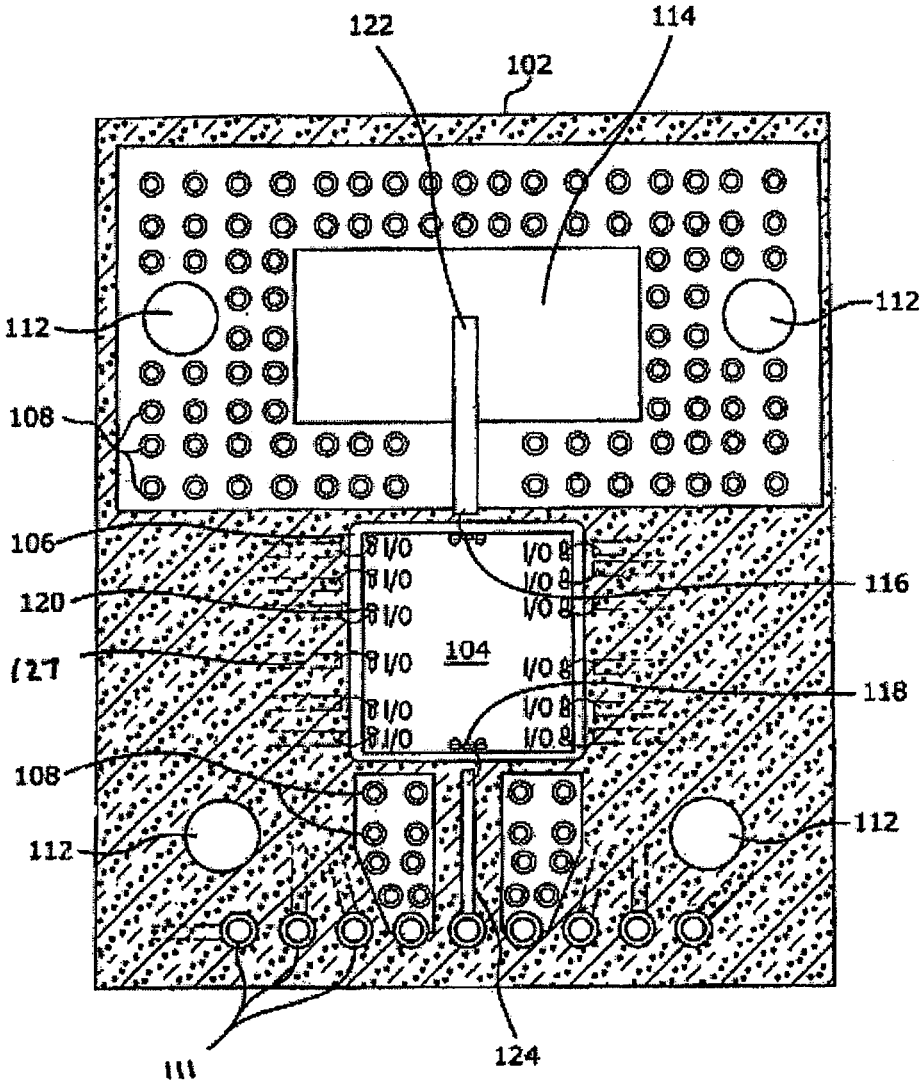
FIG. 2 illustrates an exemplary top view of a millimeter wave package.

In one exemplary embodiment, and with reference to FIG. 2, the waveguide aperture wall is in direct contact with an array of plated through holes 108 of a printed circuit board. The plated through holes 108 are further connected by a section of a first ground plane that substantially traverses the circumference of the waveguide aperture wall with an open section that has a microstrip and/or stripline connected element 122 that lies within the boundary of the waveguide aperture interface 114. The strip element 122 within the waveguide wall boundary operatively couples the signal within the waveguide to a transmission mode within the printed circuit board. In one exemplary embodiment, a backshort of a waveguide aperture is formed by a metal cavity on the distal side of the printed circuit board. In this case, the metal cavity is connected to the waveguide aperture by the path defined by plated through holes or vias 108. In an alternate exemplary embodiment, a backshort of a waveguide aperture is formed by a second ground layer within the printed circuit board connected to the first ground layer.

In an exemplary embodiment, and with reference to FIG. 2, an MMIC 104 may include an RF output 116, an RF input 118, and various input/output ports 120. The RF output 116 is wire bonded or otherwise connected to an RF probe 122. The RF probe 122 extends into the waveguide interface 114. The RF probe 122 may be used to launch an RF signal within the waveguide interface 114. In an exemplary embodiment, the waveguides aperture 125 axis are perpendicular to a printed circuit board. Thus, in one exemplary embodiment, the RF probe 122 may extend perpendicular to the printed circuit board into the waveguide interface 114. The waveguide interface 114 is configured to provide a low loss interface between a package and its surrounding components and environment.

The RF input 118 to the MMIC 104 is wire bonded or otherwise connected to a structure 124. Structure 124 may comprise, for example, a micro-strip 50 Ohm trace. Furthermore, structure 124 may, for example, be any structure capable of communicating a signal to the MMIC 104. The structure or trace 124 may be in turn connected to one of the mating vias 111. The mating vias 111 may be connected or mated through connector pins with the additional vias 108 of a mating package. The input/output ports 120 of the MMIC 104 are wire bonded or otherwise connected to various traces 127 on the PWB 102. It should be understood that the MMIC 104 may be packaged solely or with other devices and/or MMICs in a package; for example a QFN or quad flat package as a MMIC module. Furthermore, the RF signals from and to a MMIC module may operatively connect to a plurality of nearby waveguide interface 114.

The holes 112 accommodate bolts, screws, or other connectors that, for example, mechanically, secure or mount the PWB 102 and potentially other components of the package to each other or to one or more additional assemblies or structures. For example, the PWB 102 may be mounted to an adjacent heat spreader plate, chassis, additional PWBs, additional packages, or other structures through one or more of the holes 112. Holes 112 may be supplemented or replaced with other attachment structures such as other connections or spaces that provide the needed mechanical attachment among various components associated with a package. Secure mechanical connections offer predictable and desired spacing among components in order to maximize optimal thermal connections and signal communications.

Additional systems and methods for integrated wave guide interfaces are described in co-pending U.S. patent application Ser. No. 12/031,236, entitled "SYSTEM AND METHOD FOR INTEGRATED WAVEGUIDE PACKAGING" filed Feb. 14, 2008 the contents of which are hereby incorporated by reference for any purpose in their entirety.

In one exemplary embodiment, single mode waveguide apertures may be configured as transmit or receive waveguide apertures. In one exemplary embodiment, multiple single mode waveguide apertures may be configured to produce transmit or receive schemes in the transmit and receive bands of operation.

In one exemplary embodiment, the system may be capable of full duplex operation. In one exemplary embodiment, full duplex operation means that the system is capable of communicating as a transmitter and a receiver simultaneously and at the same time. In one exemplary embodiment, these waveguide apertures may be configured as single polarizations, such as vertical or horizontal. In one exemplary embodiment, multiple single mode, single polarization waveguide apertures may be combined and configured to produce desired polarizations, such as right hand circular, left hand circular, right hand elliptical, and/or left hand elliptical. For instance, in one exemplary embodiment, aggregate circular polarization may be accomplished by sequential rotation of waveguide apertures in conjunction with the appropriate phasing of pairs or sets of waveguide apertures. In one exemplary embodiment, waveguide apertures may be configured to operate with balanced feed systems (e.g. 0°, 90°, 180°, and 270°). It is recognized that the relative phase (e.g., locally 0° or 180°) of a waveguide aperture may be altered by the relative direction of the coupling element within the waveguide aperture.

In one exemplary embodiment, with renewed reference to FIG. 1B transmit waveguide apertures 126 and receive waveguide apertures 128 may be rotated for synthesis of the sub-array pattern having pseudo symmetry. Psuedo symmetry is a characteristic of a radiation pattern where orthogonal planes of the pattern about the principal radiation direction axis have a similar characteristic beamwidth values. In one exemplary embodiment, waveguide apertures 125 may be configured to produce phase inversion according to the signal launch orientation of the waveguide aperture 125. In one exemplary embodiment (discussed further below), phased array 110 comprises electronic polarization agility. In one exemplary embodiment, phased array 110 is configured to comprise low cross polarization. For instance, by arranging closely spaced pairs or sets of waveguide apertures and applying accurate phase and amplitude weights low cross polarization may be achieved. In an alternate exemplary embodiment, phased array 110 is configured to comprise low cross polarization by arranging pairs or sets of waveguide apertures that are rotated in a systematic manner relative to one another to produce an aggregate polarization characteristic that is a better quality than can be achieved with a single pair or set.

In accordance with another exemplary embodiment, phased array 110 may be any suitable phased array with any suitable number of waveguide apertures 125. In accordance with another exemplary embodiment, the operation of multiple waveguide apertures 125 may be combined to increase scan of an antenna. For instance, though any number of waveguide apertures may be combined, in one exemplary embodiment, combining about 31 transmit waveguide apertures achieves a scan of about 5°. In another exemplary embodiment, combining about 85 transmit waveguide apertures achieves a scan of about 10°. More generally, the number of elements is increased and the phased array 110 is further displaced from the focal point of reflector 150 to increase the scan angle of antenna system 100. From a geometrical optics perspective, the array 110 is sized and positioned to intersect the marginal rays of energy from reflector 150 under the conditions of maximum scan to offer a condition that maximizes the overall efficiency of the antenna system 100. In an exemplary embodiment, dithering the beam pointing may provide increased scan of the antenna system described herein. In an exemplary embodiment, the system may operate in fixed beam applications and/or limited scan applications. In an exemplary embodiment, the systems described herein may comprise a defocused array feed. In one exemplary embodiment, the equivalent isotropically radiated power (EIRP) limits are a function of the number of radiatating elements. In radio communication systems, equivalent isotropically radiated power (EIRP) or, alternatively, effective isotropically radiated power is the amount of power that an isotropic antenna (which evenly distributes power in all directions) would emit to produce the peak power density observed in the direction of maximum antenna gain.

Although various exemplary frequencies are disclosed herein, the invention is not necessarily limited to specific frequencies. Nor is the invention limited to specific antenna sizes. In one exemplary embodiment a first plurality of waveguide elements may operate in a first transmit frequency range and a first receive frequency range; and a second plurality of waveguide elements may operate in a second a transmit frequency range and a second receive frequency range. In one exemplary embodiment with reference to FIG. 1B, phased array 110 is configured to have a transmit frequency from about 28.1 GHz to about 30.0 GHz (a bandwidth of about 1900 MHz), and a receive frequency of about 18.3 GHz to about 20.2 GHz (a bandwidth of about 1900 MHz). In this embodiment, waveguide radiators may be combined to form a square lattice. In another exemplary embodiment, phased array 110 is configured to have a transmit frequency within the range of about 14.0 GHz to about 31.0 GHz (a bandwidth of about 17.0 GHz and a bandwidth ratio of 2.2 to 1) and a receive frequency within the range of about 10.7 GHz to 21.2 GHz (a bandwidth of about 10.5 GHz and a bandwidth ratio of 2.0 to 1). Ridge waveguide radiators may be preferable when the bandwidth ratio is greater than 1.5 to 1.

Figure 4:
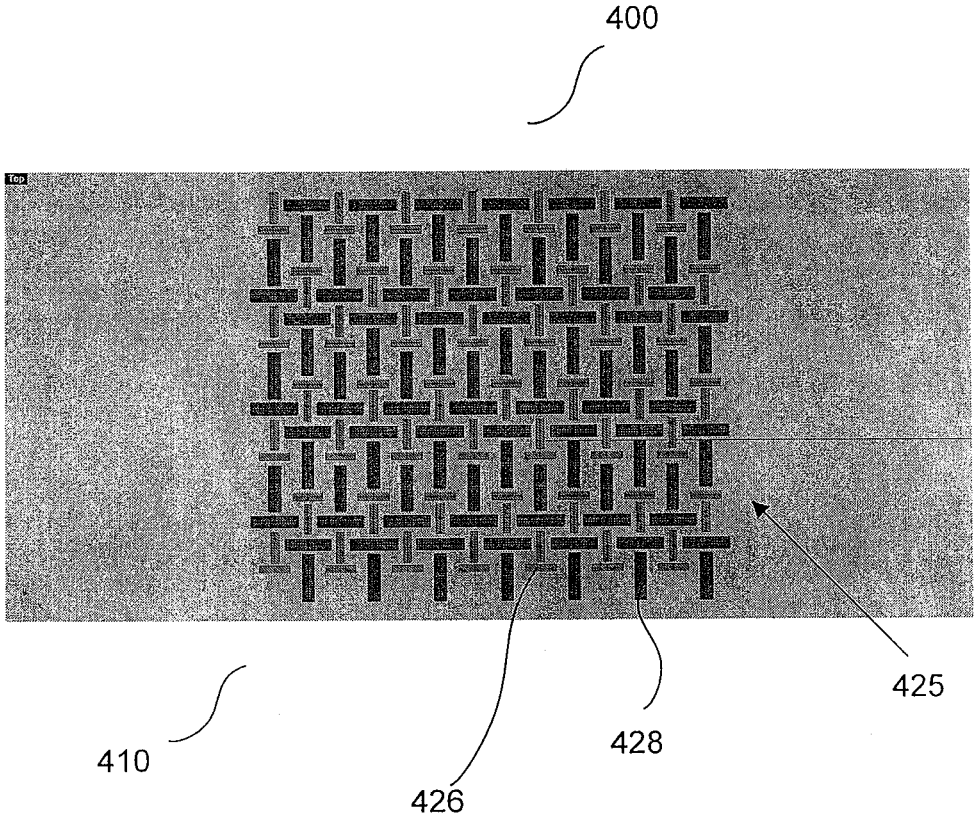
FIG. 4 is another alternate detailed illustration of an exemplary phased array topology.

In one exemplary embodiment and with reference to FIG. 4, an alternative exemplary waveguide topology 400 is presented. In this exemplary embodiment, transmit waveguide apertures 426 are configured as smaller waveguide apertures than the receive waveguide apertures 428 in accordance with the transmit operational band is higher than receive. In this exemplary embodiment, the shape and size of the smaller transmit waveguide apertures 426 is configured to filter HPA noise that would otherwise appear in the receive frequency band. In this exemplary embodiment, the system may be configured operate with a transmit frequency between about 27.5 GHz and about 31.0 GHz (a bandwidth of about 3.5 GHz) and a receive frequency between about 17.7 GHz and about 21.2 GHz (a bandwidth of about 3.5 GHz). In this embodiment, waveguide radiators 425 may be combined to form a triangular lattice. In this embodiment, waveguide radiators 425 may be combined to form a 1.75λ lattice. In this exemplary embodiment, transmit waveguide apertures 426 are 0.280 inch long and 0.07 wide (e.g. 25% of the length of waveguide apertures 426 wide). In this exemplary embodiment, receive waveguide apertures 428 are 0.420 inch long and 0.105 inch wide (e.g. 25% of the length of waveguide apertures 428 wide).

Figure 5:
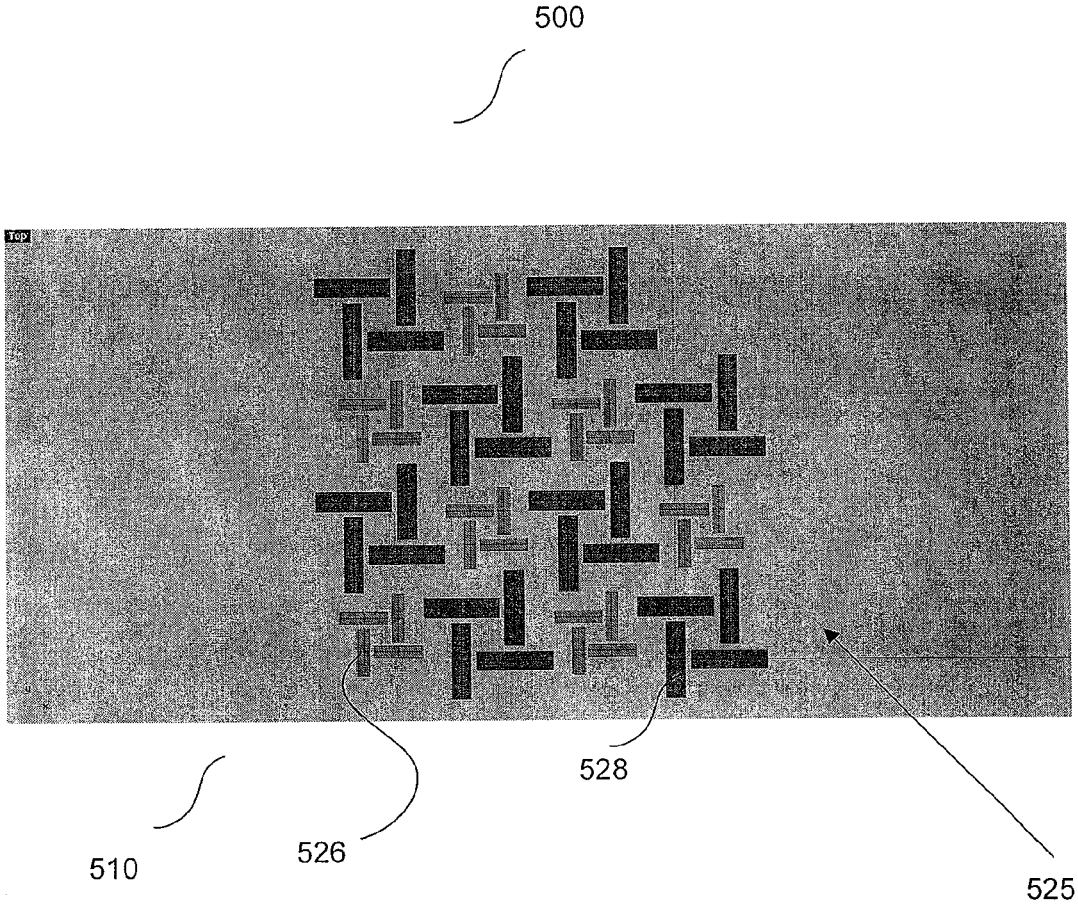
FIG. 5 is yet another detailed illustration of an exemplary phased array topology.

In one exemplary embodiment and with reference to FIG. 5, an alternative exemplary waveguide topology 500 is presented. In this exemplary embodiment, transmit waveguide apertures 526 are configured as a symmetric subarray with interleaved, dual sized waveguides 525. In this exemplary embodiment, the shape and size of the smaller transmit waveguide apertures 526 are configured to filter HPA noise that would otherwise appear in the receive frequency band. In this exemplary embodiment, the system may be configured operate with transmit frequencies between about 14.0 GHz to about 14.5 and between about 27.5 GHz to about 31.0 GHz (respective bandwidths of about 500 MHz and 3500 MHz) and receive frequencies between about 10.7 GHz to about 12.75 GHz and between about 17.7 GHz to about 21.2 GHz (respective bandwidths of about 2050 MHz and 3500 MHz). In this embodiment, waveguide radiators 525 may be combined to form a square lattice. In this embodiment, the system 500 has symmetry and may interface with a balanced fed MMIC. In this exemplary embodiment, transmit ridge loaded waveguide apertures 526 are approximately 0.3 inch long and 0.075 inch wide (e.g. 25% of the length of waveguide apertures 526 wide). In this exemplary embodiment, ridge loaded receive waveguide apertures 528 are approximately 0.5 inch long and 0.0125 inch wide (e.g. 25% of the length of waveguide apertures 528 wide).

Figure 6:
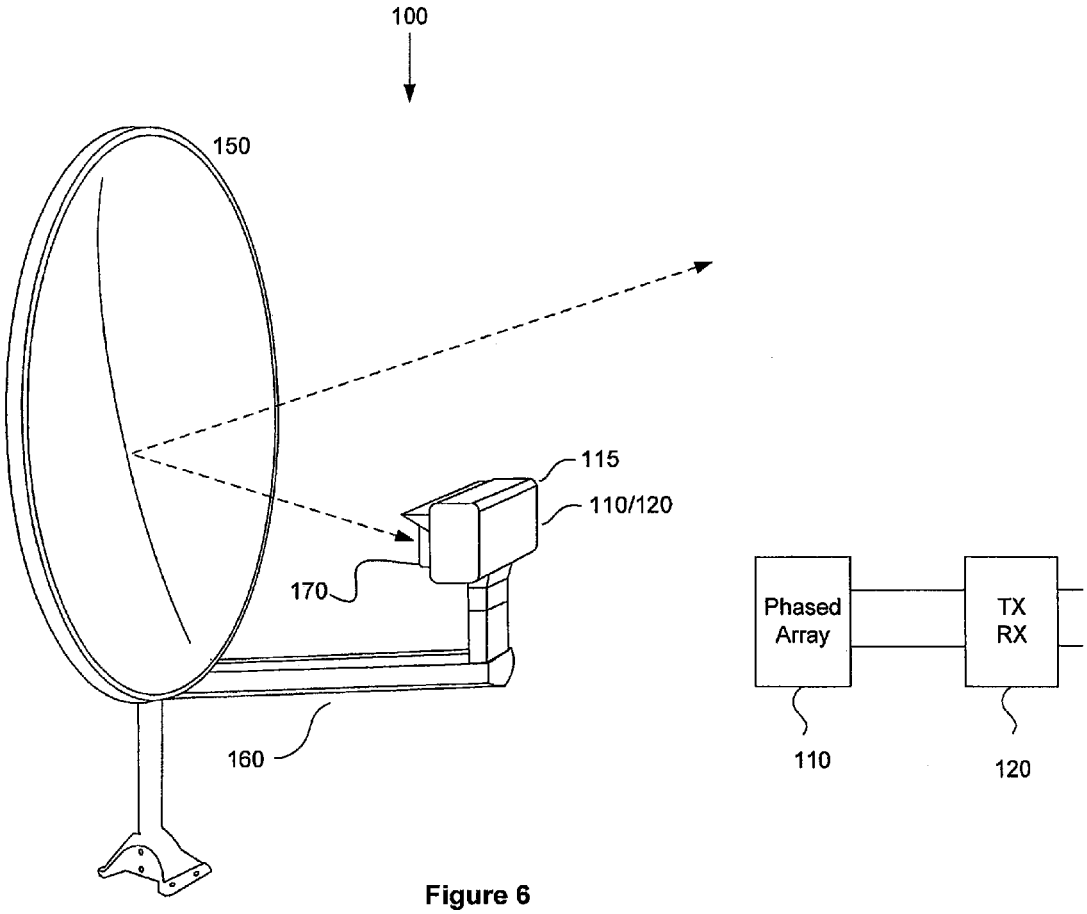
FIG. 6 illustrates an exemplary antenna system for communicating RF signals via a phased array feed.

With reference now to FIG. 6, in accordance with an exemplary embodiment, an antenna system 100 comprises a phased array 110, 410, 510, a transceiver 120, and a microwave reflector 150. Described another way, in another exemplary embodiment, antenna system 100 comprises an integrated phased array ("IPA") feed transceiver 115 and microwave reflector 150. IPA feed transceiver 115 comprises phased array 110, 410, 510 and transceiver 120.

In one exemplary embodiment with renewed reference to FIG. 6, phased array 110, 410, 510 is connected in signal communication with transceiver 120. Phased array 110 is oriented facing microwave reflector 150. In this way, phased array 110, 410, 510 may be configured to serve as a feed for a standard microwave reflector, such as a 0.75 m diameter reflector.

In accordance with an exemplary embodiment, phased array 110, 410, 510 may comprise a phased array transmit. In accordance with another exemplary embodiment, phased array 110, 410, 510 may comprise a phased array receive. In yet another exemplary embodiment, phased array 110, 410, 510 comprises both transmit and receive phased arrays.

As mentioned above, in accordance with an exemplary embodiment, phased array 110, 410, 510 is physically oriented with its boresight direction facing microwave reflector 150. Any suitable method for physically orienting phased array 110, 410, 510 to send and/or receive signals by way of microwave reflector 150 may be used.

In accordance with an exemplary embodiment, the phased array is manufactured using techniques and methods described in co-pending U.S. Provisional Application No. 61/222,354, entitled "ACTIVE PHASED ARRAY ARCHITECTURE", filed Jul. 1, 2009, along with U.S. Provisional Application No. 61/234,521, entitled "MULTI-BAND MULTI-BEAM PHASED ARRAY ARCHITECTURE", filed Aug. 17, 2009, both of which are incorporated herein in their entirety by reference. For example, the phased array may incorporate the techniques of: dynamic polarization control, dynamic amplitude control, dynamic phase control, ability to generate multiple independently steerable beams, broadband frequency capability, and low cost implementation. These techniques and/or methods facilitate manufacturing low cost phased arrays and thus the implementation of such arrays in high volume consumer applications such as those described herein.

In accordance with an exemplary embodiment of the present invention, an exemplary phased array antenna may be combined with a microwave reflector to form an antenna system. In an exemplary embodiment, the system comprises co-located transmit and receive phase centers. Thus, the system provides low cost, quasi-equal effective transmit waveguide apertures and receive waveguide apertures. In this exemplary embodiment, this antenna system replaces the standard feed structure of a feed horn, an OMT and a polarizer with the phased array. In accordance with another exemplary embodiment of the present invention, an exemplary phased array antenna is integral to a panel antenna to form an antenna system. In an exemplary embodiment these antenna systems utilizing an exemplary interleaved waveguide aperture phased array are capable of dual-polarized broadband, multi-frequency operation. In one exemplary embodiment, the system does not comprise a patch antenna.

Transceiver 120 may be connected in signal communication with phased array 110, 410, 510. Transceiver 120 may further comprise a signal input, and/or signal output. The signal input or signal output, in an exemplary embodiment may be connected in signal communication with a modem or the like. The modem, or similar device, may be configured to send and/or receive signals to/from transceiver 120. In one exemplary embodiment, the signal input/output are coaxial cable intermediate frequency connectors. These connectors may be configured for secure attachment to coaxial cable(s) between the modem and transceiver 120. Moreover, any suitable method of providing signals to or receiving signals from transceiver 120 may be used.

Although described herein as a transceiver, it should be understood that wherever applicable through out this description the transceiver may be only a transmitter or only a receiver. Generally, however, transceiver 120 may comprise any typical transceiver components suitable for communication of RF signals. In an exemplary embodiment, the transmit portion of the transceiver may comprise a transmit up-converter, such as a block up-converter ("BUC"). In another exemplary embodiment, the receive portion of the transceiver may comprise a receive down-converter, such as a low noise block ("LNB") down-converter. Thus, transceiver 120 may comprise any suitable transmitter, receiver, or transceiver components suitable for communication of RF signals in accordance with this disclosure.

In contrast to prior art antenna systems, antenna system 100 does not comprise an orthomode transducer ("OMT"), a polarizer, or a feed horn. These devices are typically mechanical or die-cast formed feed components and are typically found in use in reflector type antennas in consumer broadband internet satellite systems. In an exemplary embodiment, the OMT, polarizer and feed horn components are replaced by a phased array feed.

Figure 7:
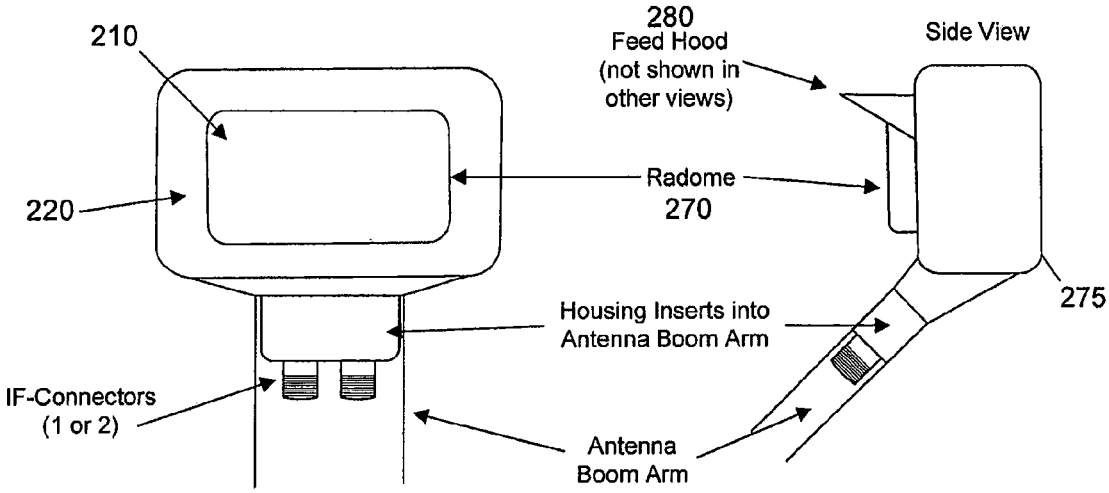
FIG. 7 is a detailed illustration of various exemplary views of a phased array.

With further reference to FIG. 7, it is noted that antenna system 100 may further comprise a radome. The radome may be configured to cover the phased array 110, 410, 510. The radome may be configured to protect the phased array from environmental conditions such as debris or rain.

Figure 8A:
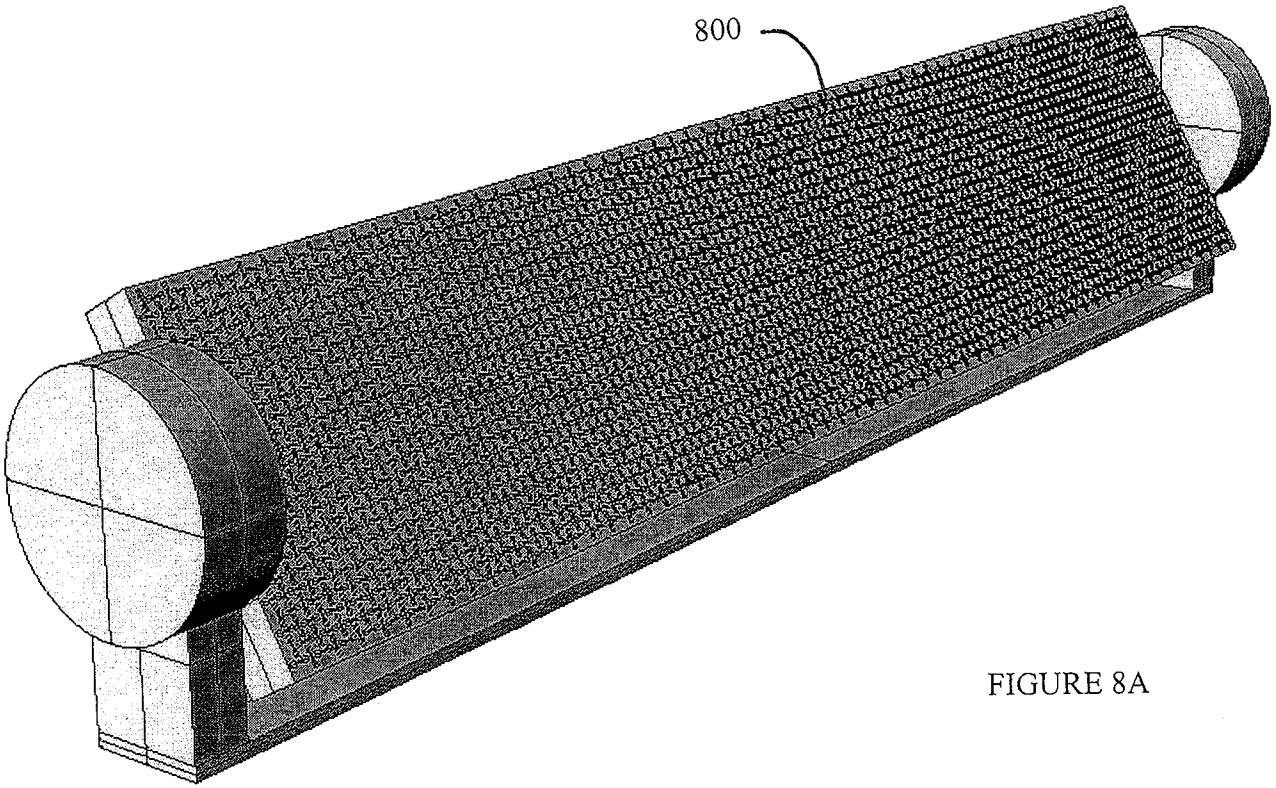
FIGS. 8A-8C illustrates various views of an exemplary antenna system for communicating RF signals via a panel antenna using a phased array.
Figure 8B:
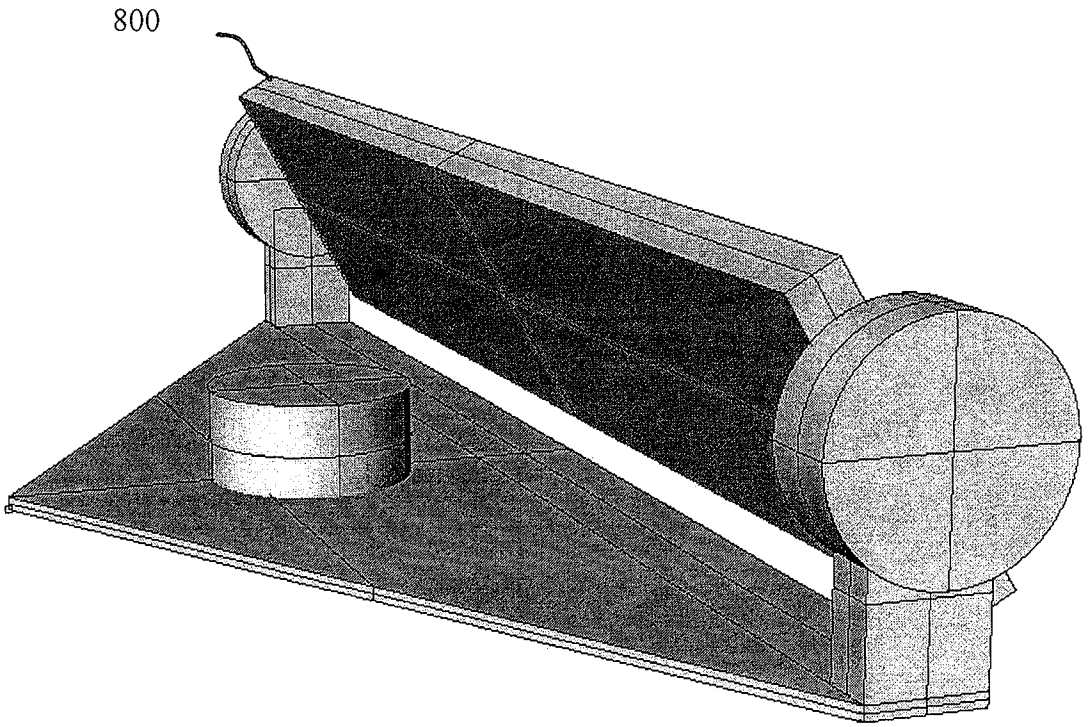
Figure 8C:
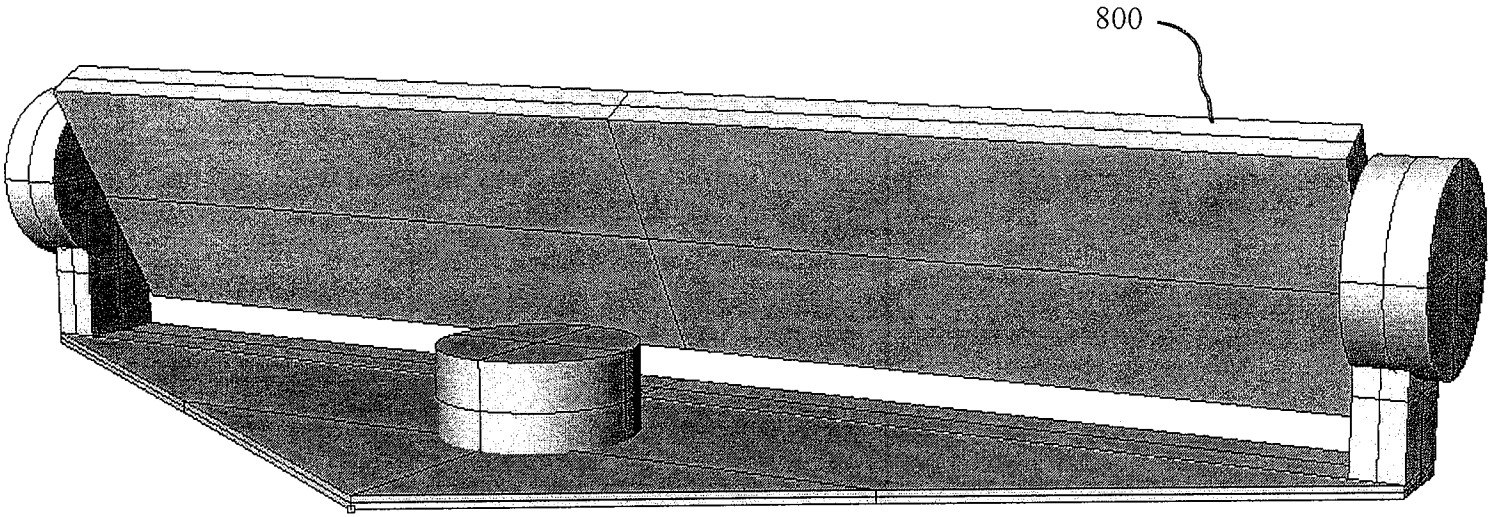

In one exemplary embodiment with reference to FIGS. 8A-8C, phased array 110, 410, 510 is configured as panel antenna 800. A panel antenna may be mounted on a mechanical positioner system for a mobile SATCOM or COTM application and panel antenna 800 may offer limited scan electronic scan capability in addition to electronic polarization agility. A hybrid scan antenna system that uses rapid electronic scan over a limited field of view relative to the mechanical boresight and coarse positioning with the mechanical positioner can be advantageously used in antenna tracking systems for ground based vehicular COTM applications over rough terrain. Panel antenna 800 may be relatively thin and offer solutions to medium profile class antennas where the swept volume is less than 10 inches height above a mounting surface on the vehicle. In one exemplary embodiment, panel antenna 800 may be configured with transmit and receive RF interfaces at the operational frequency bands or may be configured to include frequency converters to provide intermediate frequency (IF) interfaces such as L-band.

Point to Point or Satellite.

The antenna system and methods of the present disclosure are applicable to fixed wireless access terminals. One example of this is Local Multipoint Distribution Service (LMDS) systems operating at mm wave frequency. As another example, the teachings of this disclosure are equally applicable in the context of any wireless point to point microwave systems. For example, the antenna system may be configured to be used in wireless point-to-point (PTP) systems that are used between cell towers and/or buildings and can operate at W-Band frequencies as high as 95 GHz where pointing may become very difficult even for small antennas. Although described herein in the context of terrestrial applications, it should be appreciated that the teachings of this disclosure are equally applicable in the context of ground to satellite communications.

Electronic Switching of Polarization

In accordance with an exemplary embodiment, antenna system 100 comprising phased array 110, 410, 510 is configured to facilitate electronic switching of polarization and continuous variation of polarization for polarization tracking such as is necessary for mobile SATCOM applications at Ku-band using fixed satellite services (FSS) infrastructure. For example, antenna system 100 may be configured to facilitate electronic switching of polarization between left and right hand circular. In another exemplary embodiment, antenna system 100 is configured to facilitate electronic switching of polarization between horizontal linear and vertical linear. In other exemplary embodiments, antenna system 100 may be configured to facilitate electronic alignment of linear polarization.

Such electronic switching or alignment of polarization may be facilitated through use of appropriate phase delay(s) and/or in the case of alignment may be accomplished with appropriate amplitude weights. In various exemplary embodiments, antenna system 100 is configured to move a customer from one polarization to another. This may occur in an electronic and automated manner. In one exemplary embodiment, antenna system 100 is configured to be remotely controlled to switch from one polarization to another. In other exemplary embodiments, a mechanical device and/or manual methods may be used to move a customer from one polarization to another.

The ability to electronically switch from one polarization to another facilitates optimizing the utilization factors on the RF channels. In the prior art, if one wished to change a transceiver polarization, for example from left hand linear polarization to right hand linear polarization, it would require a technician to physically disassemble the polarizer and attach it rotated from its previous position. Clearly this could not be done with much frequency and only a limited number (on the order of 10 or maybe 20) of transceivers could be switched per technician in a day. Although electromechanical methods of switching polarization, described in co-pending provisional application Ser. No. 61/259,053, entitled "ELECTROMECHANICAL POLARIZATION SWITCH," filed Nov. 6, 2009, the contents of which are hereby incorporated by reference in their entirety, alleviate some of these concerns, such systems may be limited in the number of times they can switch polarization due to their mechanical components.

In accordance with an exemplary embodiment, antenna system 200, comprising phased array 110, 410, 510 is configured to switch polarization electronically. For example, antenna system 200 may be configured to perform dynamic load leveling by electronic polarization switching. In an exemplary embodiment, the switching may occur with any frequency. For example, the polarization may be switched during the evening hours, and then switched back during business hours to reflect transmission load variations that occur over time. In an exemplary embodiment, the polarization switching occurs instantaneously or nearly instantaneously. Thus, a large number of antenna systems communicating with a single satellite, for example, can be actively managed in real time to account for variations in usage across the entire group of antenna systems, causing load variations.

In an exemplary embodiment, the polarization switching is initiated from a remote location. For example, a central system may determine that load changes have significantly slowed down the left hand polarized channel, but that the right hand polarized channel has available bandwidth. The central system could then remotely switch the polarization of a number of antenna systems (in this example, from left to right hand polarization). This would improve channel availability for switched and non-switched users alike.

Multi Color System:

In the field of consumer satellite RF communication, a satellite will typically transmit and/or receive data (e.g., movies and other television programming, internet data, and/or the like) to consumers who have personal satellite dishes at their home. More recently, the satellites may transmit/receive data from more mobile platforms (such as, transceivers attached to airplanes, trains, and/or automobiles). It is anticipated that increased use of handheld or portable satellite transceivers will be the norm in the future. Although sometimes described in this document in connection with home satellite transceivers, the prior art limitations now discussed may be applicable to any personal consumer terrestrial transceivers (or transmitters or receivers) that communicate with a satellite.

A propagating radio frequency (RF) signal can have different polarizations, namely linear, elliptical, or circular. Linear polarization consists of vertical polarization and horizontal polarization, whereas circular polarization consists of left-hand circular polarization (LHCP) and right-hand circular polarization (RHCP). An antenna is typically configured to pass one polarization, such as LHCP, and reject the other polarization, such as RHCP.

Also, conventional very small aperture terminal (VSAT) antennas utilize a fixed polarization that is hardware dependant. The basis polarization is generally set during installation of the satellite terminal, at which point the manual configuration of the polarizer hardware is fixed. For example, a polarizer is generally set for LHCP or RHCP and fastened into position. To change polarization in a conventional VSAT antenna might require unfastening the polarizer, rotating it 90 degrees to the opposite circular polarization, and then refastening the polarizer. Clearly this could not be done with much frequency and only a limited number (on the order of 5 or maybe 10) of transceivers could be switched per technician in a given day.

Unlike a typical single polarization antenna, some devices are configured to change polarizations without disassembling the antenna terminal. As an example, a prior embodiment is the use of "baseball" switches to provide electronically commandable switching between polarizations. The rotation of the "baseball" switches causes a change in polarization by connecting one signal path and terminating the other signal path. However, each "baseball" switch requires a separate rotational actuator with independent control circuitry, which increases the cost of device such that this configuration is not used (if at all) in consumer broadband or VSAT terminals, but is instead used for large ground stations with a limited number of terminals.

Furthermore, another approach is to have a system with duplicate hardware for each polarization. The polarization selection is achieved by completing or enabling the path of the desired signal and deselecting the undesired signal. This approach is often used in receive-only terminals, for example satellite television receivers having low-cost hardware. However, with two way terminals that both transmit and receive such as VSAT or broadband terminals, doubling the hardware greatly increases the cost of the terminal.

Conventional satellites may communicate with the terrestrial based transceivers via radio frequency signals at a particular frequency band and a particular polarization. Each combination of a frequency band and polarization is known as a "color". The satellite will transmit to a local geographic area with signals in a "beam" and the geographic area that can access signals on that beam may be represented by "spots" on a map. Each beam/spot will have an associated "color." Thus, beams of different colors will not have the same frequency, the same polarization, or both.

In practice, there is some overlap between adjacent spots, such that at any particular point there may be two, three, or more beams that are "visible" to any one terrestrial transceiver. Adjacent spots will typically have different "colors" to reduce noise/interference from adjacent beams.

In the prior art, broadband consumer satellite transceivers are typically set to one color and left at that setting for the life of the transceiver. Should the color of the signal transmitted from the satellite be changed, all of the terrestrial transceivers that were communicating with that satellite on that color would be immediately stranded or cut off. Typically, a technician would have to visit the consumer's home and manually change out (or possibly physically disassemble and re-assemble) the transceiver or polarizer to make the consumer's terrestrial transceiver once again be able to communicate with the satellite on the new "color" signal. The practical effect of this is that in the prior art, no changes are made to the signal color transmitted from the satellite.

For similar reasons, a second practical limitation is that terrestrial transceivers are typically not changed from one color to another (i.e. if they are changed, it is a manual process). Thus, there is a need for a new low cost method and device to remotely change the frequency and/or polarization of an antenna system. There is also a need for a method and device that may be changed nearly instantaneously and often.

In spot beam communication satellite systems, both frequency and polarization diversity are utilized to reduce interference from adjacent spot beams. In an exemplary embodiment, both frequencies and polarizations are re-used in other beams that are geographically separated to maximize communications traffic capacity. The spot beam patterns are generally identified on a map using different colors to identify the combination of frequency and polarity used in that spot beam. The frequency and polarity re-use pattern is then defined by how many different combinations (or "colors") are used.

Figure 9:
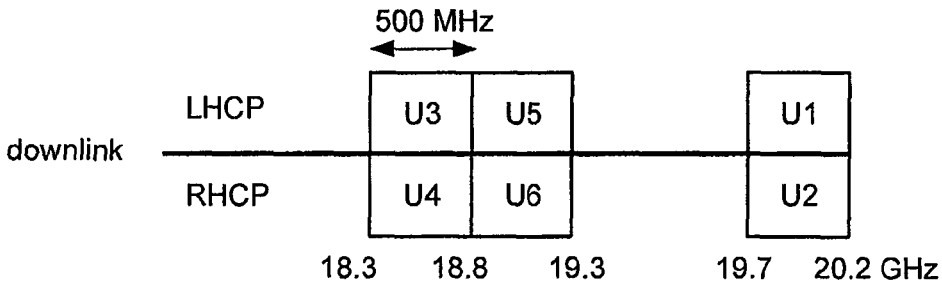
FIG. 9 depicts various block diagrams illustrating an exemplary implementation of multi color switching, in accordance with exemplary embodiments.
Figure 9:
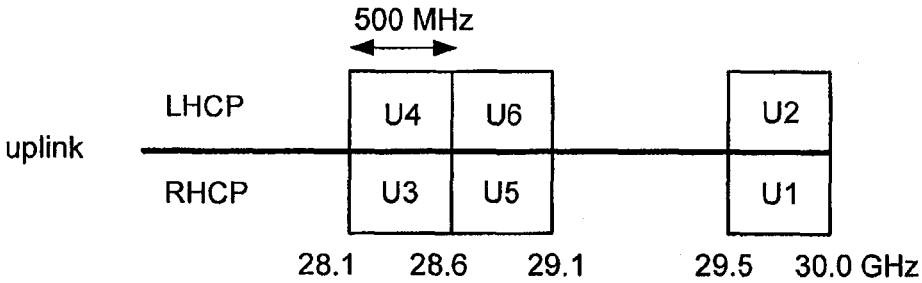
Figure 9:
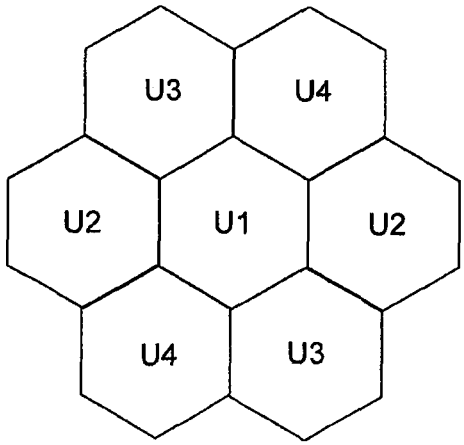
Figure 9:
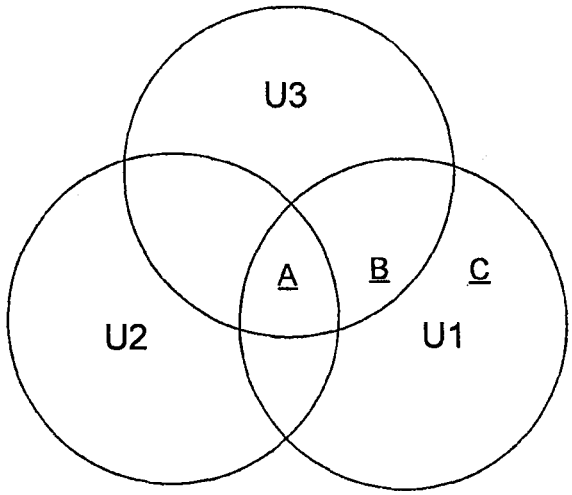

In accordance with various exemplary embodiments and with reference to FIG. 9, an antenna system is configured for frequency and polarization switching. In one specific exemplary embodiment, the frequency and polarization switching comprises switching between two frequency ranges and between two different polarizations. This may be known as four color switching. In other exemplary embodiments, the frequency and polarization switching comprises switching between three frequency ranges and between two different polarizations, for a total of six separate colors. Furthermore, in various exemplary embodiments, the frequency and polarization switching may comprise switching between two polarizations with any suitable number of frequency ranges. In another exemplary embodiment, the frequency and polarization switching may comprise switching between more than two polarizations with any suitable number of frequency ranges.

In accordance with various exemplary embodiments, the ability to perform frequency and polarization switching has many benefits in terrestrial microwave communications terminals. For example, doing so may facilitate increased bandwidth, load shifting, roaming, increased data rate/download speeds, improved overall efficiency of a group of users on the system, or improved individual data communication rates. Terrestrial microwave communications terminals, in one exemplary embodiment, comprise point to point terminals. In another exemplary embodiment, terrestrial microwave communications terminals comprise ground terminals for use in communication with any satellite, such as a satellite configured to switch frequency range and/or polarity of a RF signal broadcasted. These terrestrial microwave communications terminals are spot beam based systems.

In accordance with various exemplary embodiments, a satellite configured to communicate one or more RF signal beams each associated with a spot and/or color has many benefits in microwave communications systems. For example, similar to what was stated above for exemplary terminals in accordance with various embodiments, doing so may facilitate increased bandwidth, load shifting, roaming, increased data rate/download speeds, improved overall efficiency of a group of users on the system, or improved individual data communication rates. In accordance with another exemplary embodiment, the satellite is configured to remotely switch frequency range and/or polarity of a RF signal broadcasted by the satellite. This has many benefits in microwave communications systems. In another exemplary embodiment, satellites are in communications with any suitable terrestrial microwave communications terminal, such as a terminal having the ability to perform frequency and/or polarization switching.

Prior art spot beam based systems use frequency and polarization diversity to reduce or eliminate interference from adjacent spot beams. This allows frequency reuse in non-adjacent beams resulting in increased satellite capacity and throughput. Unfortunately, in the prior art, in order to have such diversity, installers of such systems must be able to set the correct polarity at installation or carry different polarity versions of the terminal. For example, at an installation site, an installer might carry a first terminal configured for left hand polarization and a second terminal configured for right hand polarization and use the first terminal in one geographic area and the second terminal in another geographic area. Alternatively, the installer might be able to disassemble and reassemble a terminal to switch it from one polarization to another polarization. This might be done, for example, by removing the polarizer, rotating it 90 degrees, and reinstalling the polarizer in this new orientation. These prior art solutions are cumbersome in that it is not desirable to have to carry a variety of components at the installation site. Also, the manual disassembly/reassembly steps introduce the possibility of human error and/or defects.

These prior art solutions, moreover, for all practical purposes, permanently set the frequency range and polarization for a particular terminal. This is so because any change to the frequency range and polarization will involve the time and expense of a service call. An installer would have to visit the physical location and change the polarization either by using the disassembly/re-assembly technique or by just switching out the entire terminal. In the consumer broadband satellite terminal market, the cost of the service call can exceed the cost of the equipment and in general manually changing polarity in such terminals is economically unfeasible.

In accordance with various exemplary embodiments, a low cost system and method for electronically or electro-mechanically switching frequency ranges and/or polarity is provided. In an exemplary embodiment, the frequency range and/or polarization of a terminal can be changed without a human touching the terminal. Stated another way, the frequency range and/or polarization of a terminal can be changed without a service call. In an exemplary embodiment, the system is configured to remotely cause the frequency range and/or polarity of the terminal to change.

In one exemplary embodiment, the system and method facilitate installing a single type of terminal that is capable of being electronically set to a desired frequency range from among two or more frequency ranges. Some exemplary frequency ranges include receiving 10.7 GHz to 12.75 GHz, transmitting 13.75 GHz to 14.5 GHz, receiving 18.3 GHz to 20.2 GHz, and transmitting 28.1 GHz to 30.0 GHz. Furthermore, other desired frequency ranges of a point-to-point system fall within 15 GHz to 38 GHz. In another exemplary embodiment, the system and method facilitate installing a single type of terminal that is capable of being electronically set to a desired polarity from among two or more polarities. The polarities may comprise, for example, left hand circular, right hand circular, vertical linear, horizontal linear, or any other orthogonal polarization. Moreover, in various exemplary embodiments, a single type of terminal may be installed that is capable of electronically selecting both the frequency range and the polarity of the terminal from among choices of frequency range and polarity, respectively.

In an exemplary embodiment, transmit and receive signals are paired so that a common switching mechanism switches both signals simultaneously. For example, one "color" may be a receive signal in the frequency range of 19.7 GHz to 20.2 GHz using RHCP, and a transmit signal in the frequency range of 29.5 GHz to 30.0 GHz using LHCP. Another "color" may use the same frequency ranges but transmit using RHCP and receive using LHCP. Accordingly, in an exemplary embodiment, transmit and receive signals are operated at opposite polarizations. However, in some exemplary embodiments, transmit and receive signals are operated on the same polarization which increases the signal isolation requirements for self-interference free operation.

Thus, a single terminal type may be installed that can be configured in a first manner for a first geographical area and in a second manner for a second geographical area that is different from the first area, where the first geographical area uses a first color and the second geographical area uses a second color different from the first color.

In accordance with an exemplary embodiment, a terminal, such as a terrestrial microwave communications terminal, may be configured to facilitate load balancing. In accordance with another exemplary embodiment, a satellite may be configured to facilitate load balancing. Load balancing involves moving some of the load on a particular satellite, or point-to-point system, from one polarity/frequency range "color" or "beam" to another. In an exemplary embodiment, the load balancing is enabled by the ability to remotely switch frequency range and/or polarity of either the terminal or the satellite.

Thus, in exemplary embodiments, a method of load balancing comprises the steps of remotely switching frequency range and/or polarity of one or more terrestrial microwave communications terminals. For example, system operators or load monitoring computers may determine that dynamic changes in system bandwidth resources has created a situation where it would be advantageous to move certain users to adjacent beams that may be less congested. In one example, those users may be moved back at a later time as the loading changes again. In an exemplary embodiment, this signal switching (and therefore this satellite capacity "load balancing") can be performed periodically. In other exemplary embodiments, load balancing can be performed on many terminals (e.g., hundreds or thousands of terminals) simultaneously or substantially simultaneously. In other exemplary embodiments, load balancing can be performed on many terminals without the need for thousands of user terminals to be manually reconfigured.

In one exemplary embodiment, dynamic control of signal polarization is implemented for secure communications by utilizing polarization hopping. Communication security can be enhanced by changing the polarization of a communications signal at a rate known to other authorized users. An unauthorized user will not know the correct polarization for any given instant and if using a constant polarization, the unauthorized user would only have the correct polarization for brief instances in time. A similar application to polarization hopping for secure communications is to use polarization hopping for signal scanning. In other words, the polarization of the antenna can be continuously adjusted to monitor for signal detection.

In an exemplary embodiment, the load balancing is performed as frequently as necessary based on system loading. For example, load balancing could be done on a seasonal basis. For example, loads may change significantly when schools, colleges, and the like start and end their sessions. As another example, vacation seasons may give rise to significant load variations. For example, a particular geographic area may have a very high load of data traffic. This may be due to a higher than average population density in that area, a higher than average number of transceivers in that area, or a higher than average usage of data transmission in that area. In another example, load balancing is performed on an hourly basis. Furthermore, load balancing could be performed at any suitable time. In one example, if maximum usage is between 6-7 PM then some of the users in the heaviest loaded beam areas could be switched to adjacent beams in a different time zone. In another example, if a geographic area comprises both office and home terminals, and the office terminals experience heaviest loads at different times than the home terminals, the load balancing may be performed between home and office terminals. In yet another embodiment, a particular area may have increased localized signal transmission traffic, such as related to high traffic within businesses, scientific research activities, graphic/video intensive entertainment data transmissions, a sporting event or a convention. Stated another way, in an exemplary embodiment, load balancing may be performed by switching the color of any subgroup(s) of a group of transceivers.

In an exemplary embodiment, the consumer broadband terrestrial terminal is configured to determine, based on preprogrammed instructions, what colors are available and switch to another color of operation. For example, the terrestrial terminal may have visibility to two or more beams (each of a different color). The terrestrial terminal may determine which of the two or more beams is better to connect to. This determination may be made based on any suitable factor. In one exemplary embodiment, the determination of which color to use is based on the data rate, the download speed, and/or the capacity on the beam associated with that color. In other exemplary embodiments, the determination is made randomly, or in any other suitable way.

This technique is useful in a geographically stationary embodiment because loads change over both short and long periods of time for a variety of reasons and such self adjusting of color selection facilitates load balancing. This technique is also useful in mobile satellite communication as a form of "roaming". For example, in one exemplary embodiment, the broadband terrestrial terminal is configured to switch to another color of operation based on signal strength. This is, in contrast to traditional cell phone type roaming, where that roaming determination is based on signal strength. In contrast, here, the color distribution is based on capacity in the channel. Thus, in an exemplary embodiment, the determination of which color to use may be made to optimize communication speed as the terminal moves from one spot to another. Alternatively, in an exemplary embodiment, a color signal broadcast by the satellite may change or the spot beam may be moved and still, the broadband terrestrial terminal may be configured to automatically adjust to communicate on a different color (based, for example, on channel capacity).

Figure 10A:
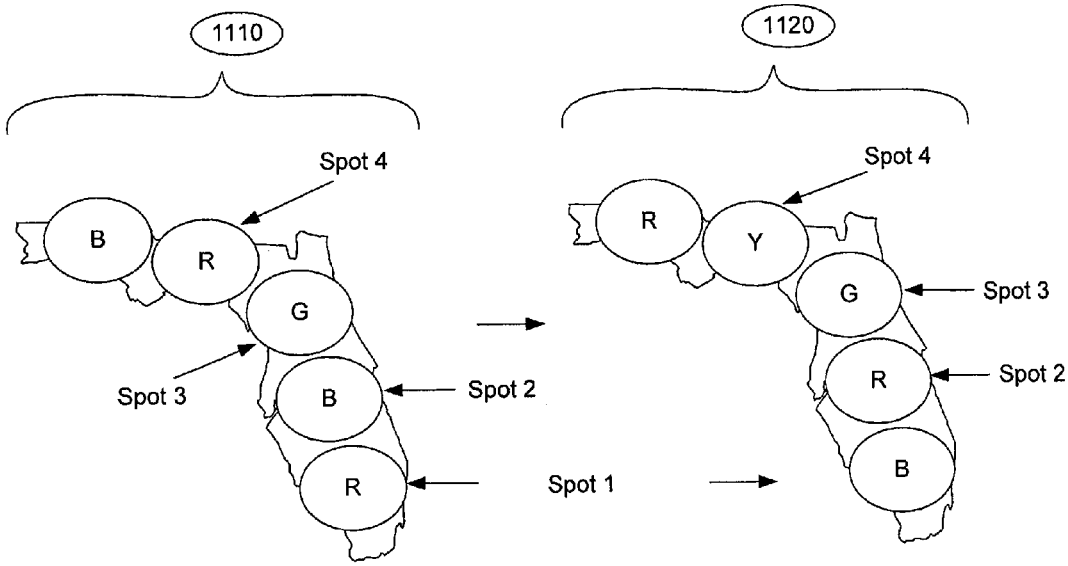
FIGS. 10A-10C illustrate various exemplary satellite spot beam multicolor agility methods in accordance with exemplary embodiments.

In accordance with another exemplary embodiment, a satellite is configured to communicate one or more RF signal beams each associated with a spot and/or color. In accordance with another exemplary embodiment, the satellite is configured to remotely switch frequency range and/or polarity of a RF signal broadcasted by the satellite. In another exemplary embodiment, a satellite may be configured to broadcast additional colors. For example, an area and/or a satellite might only have 4 colors at a first time, but two additional colors, (making 6 total colors) might be dynamically added at a second time. In this event, it may be desirable to change the color of a particular spot to one of the new colors. With reference to FIG. 10A, spot 4 changes from "red" to then new color "yellow". In one exemplary embodiment, the ability to add colors may be a function of the system's ability to operate, both transmit and/or receive over a wide bandwidth within one device and to tune the frequency of that device over that wide bandwidth.

In accordance with an exemplary embodiment, and with renewed reference to FIG. 9, a satellite may have a downlink, an uplink, and a coverage area. The coverage area may be comprised of smaller regions each corresponding to a spot beam to illuminate the respective region. Spot beams may be adjacent to one another and have overlapping regions. A satellite communications system has many parameters to work: (1) number of orthogonal time or frequency slots (defined as color patterns hereafter); (2) beam spacing (characterized by the beam roll-off at the cross-over point); (3) frequency re-use patterns (the re-use patterns can be regular in structures, where a uniformly distributed capacity is required); and (4) numbers of beams (a satellite with more beams will provide more system flexibility and better bandwidth efficiency). Polarization may be used as a quantity to define a re-use pattern in addition to time or frequency slots. In one exemplary embodiment, the spot beams may comprise a first spot beam and a second spot beam. The first spot beam may illuminate a first region within a geographic area, in order to send information to a first plurality of subscriber terminals. The second spot beam may illuminate a second region within the geographic area and adjacent to the first region, in order to send information to a second plurality of subscriber terminals. The first and second regions may overlap.

The first spot beam may have a first characteristic polarization. The second spot beam may have a second characteristic polarization that is orthogonal to the first polarization. The polarization orthogonality serves to provide an isolation quantity between adjacent beams. Polarization may be combined with frequency slots to achieve a higher degree of isolation between adjacent beams and their respective coverage areas. The subscriber terminals in the first beam may have a polarization that matches the first characteristic polarization. The subscriber terminals in the second beam may have a polarization that matches the second characteristic polarization.

The subscriber terminals in the overlap region of the adjacent beams may be optionally assigned to the first beam or to the second beam. This optional assignment is a flexibility within the satellite system and may be altered through reassignment following the start of service for any subscriber terminals within the overlapping region. The ability to remotely change the polarization of a subscriber terminal in an overlapping region illuminated by adjacent spot beams is an important improvement in the operation and optimization of the use of the satellite resources for changing subscriber distributions and quantities. For example it may be an efficient use of satellite resources and improvement to the individual subscriber service to reassign a user or a group of users from a first beam to a second beam or from a second beam to a first beam. Satellite systems using polarization as a quantity to provide isolation between adjacent beams may thus be configured to change the polarization remotely by sending a signal containing a command to switch or change the polarization from a first polarization state to a second orthogonal polarization state. The intentional changing of the polarization may facilitate reassignment to an adjacent beam in a spot beam satellite system using polarization for increasing a beam isolation quantity.

The down link may comprise multiple "colors" based on combinations of selected frequency and/or polarizations. Although other frequencies and frequency ranges may be used and other polarizations as well, an example is provided of one multicolor embodiment. For example, and with renewed reference to FIG. 9, in the downlink, colors U1, U3, and U5 are Left-Hand Circular Polarized ("LHCP") and colors U2, U4, and U6 are Right-Hand Circular Polarized ("RHCP"). In the frequency domain, colors U3 and U4 are from 18.3-18.8 GHz; U5 and U6 are from 18.8-19.3 GHz; and U1 and U2 are from 19.7-20.2 GHz. It will be noted that in this exemplary embodiment, each color represents a 500 MHz frequency range. Other frequency ranges may be used in other exemplary embodiments. Thus, selecting one of LHCP or RHCP and designating a frequency band from among the options available will specify a color. Similarly, the uplink comprises frequency/polarization combinations that can be each designated as a color. Often, the LHCP and RHCP are reversed as illustrated, providing increased signal isolation, but this is not necessary. In the uplink, colors U1, U3, and U5 are RHCP and colors U2, U4, and U6 are LHCP. In the frequency domain, colors U3 and U4 are from 28.1-28.6 GHz; U5 and U6 are from 28.6-29.1 GHz; and U1 and U2 are from 29.5-30.0 GHz. It will be noted that in this exemplary embodiment, each color similarly represents a 500 MHz frequency range.

In an exemplary embodiment, the satellite may broadcast one or more RF signal beam (spot beam) associated with a spot and a color. This satellite is further configured to change the color of the spot from a first color to a second, different, color. Thus, with renewed reference to FIG. 10A, spot 1 is changed from "red" to "blue".

When the color of one spot is changed, it may be desirable to change the colors of adjacent spots as well. Again with reference to FIG. 10A, the map shows a group of spot colors at a first point in time, where this group at this time is designated 1110, and a copy of the map shows a group of spot colors at a second point in time, designated 1120. Some or all of the colors may change between the first point in time and the second point in time. For example spot 1 changes from red to blue and spot 2 changes from blue to red. Spot 3, however, stays the same. In this manner, in an exemplary embodiment, adjacent spots are not identical colors.

Some of the spot beams are of one color and others are of a different color. For signal separation, the spot beams of similar color are typically not located adjacent to each other. In an exemplary embodiment, and with reference again to FIG. 9, the distribution pattern illustrated provides one exemplary layout pattern for four color spot beam frequency reuse. It should be recognized that with this pattern, color U1 will not be next to another color U1, etc. It should be noted, however, that typically the spot beams will over lap and that the spot beams may be better represented with circular areas of coverage. Furthermore, it should be appreciated that the strength of the signal may decrease with distance from the center of the circle, so that the circle is only an approximation of the coverage of the particular spot beam. The circular areas of coverage may be overlaid on a map to determine what spot beam(s) are available in a particular area.

In accordance with an exemplary embodiment, the satellite is configured to shift one or more spots from a first geographic location to a second geographic location. This may be described as shifting the center of the spot from a first location to a second location. This might also be described as changing the effective size (e.g. diameter) of the spot. In accordance with an exemplary embodiment, the satellite is configured to shift the center of the spot from a first location to a second location and/or change the effective size of one or more spots. In the prior art, it would be unthinkable to shift a spot because such an action would strand terrestrial transceivers. The terrestrial transceivers would be stranded because the shifting of one or more spots would leave some terrestrial terminals unable to communicate with a new spot of a different color.

However, in an exemplary embodiment, the transceivers are configured to easily switch colors. Thus, in an exemplary method, the geographic location of one or more spots is shifted and the color of the terrestrial transceivers may be adjusted as needed.

Figure 10B:
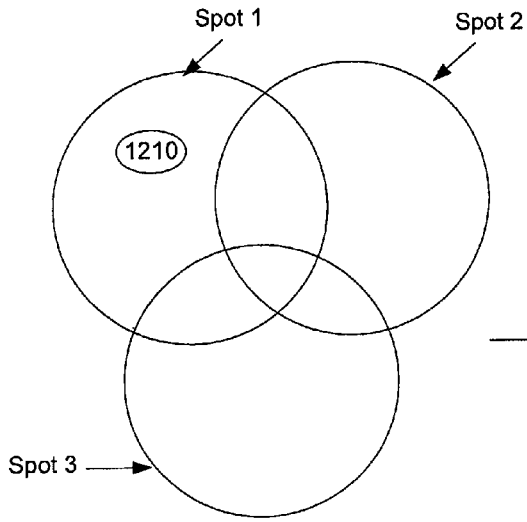
Figure 10C:
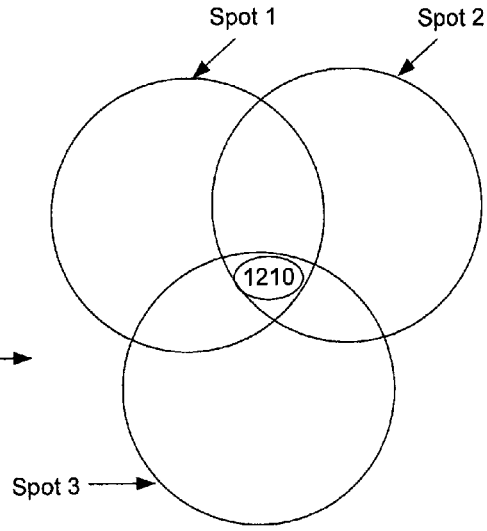

In an exemplary embodiment, the spots are shifted such that a high load geographic region is covered by two or more overlapping spots. For example, with reference to FIGS. 10B and 10C, a particular geographic area 1210 may have a very high load of data traffic. In this exemplary embodiment, area 1210 is only served by spot 1 at a first point in time illustrated by FIG. 10B. At a second point in time illustrated by FIG. 10C, the spots have been shifted such that area 1210 is now served or covered by spots 1, 2, and 3. In this embodiment, terrestrial transceivers in area 1210 may be adjusted such that some of the transceivers are served by spot 1, others by spot 2, and yet others by spot 3. In other words, transceivers in area 1210 may be selectively assigned one of three colors. In this manner, the load in this area can be shared or load-balanced.

In an exemplary embodiment, the switching of the satellites and/or terminals may occur with any regularity. For example, the polarization may be switched during the evening hours, and then switched back during business hours to reflect transmission load variations that occur over time. In an exemplary embodiment, the polarization may be switched thousands of times during the life of elements in the system.

In one exemplary embodiment, the color of the terminal is not determined or assigned until installation of the terrestrial transceiver. This is in contrast to units shipped from the factory set as one particular color. The ability to ship a terrestrial transceiver without concern for its "color" facilitates simpler inventory processes, as only one unit (as opposed to two or four or more) need be stored. In an exemplary embodiment, the terminal is installed, and then the color is set in an automated manner (i.e. the technician can't make a human error) either manually or electronically. In another exemplary embodiment, the color is set remotely such as being assigned by a remote central control center. In another exemplary embodiment, the unit itself determines the best color and operates at that color.

As can be noted, the determination of what color to use for a particular terminal may be based on any number of factors. The color may based on what signal is strongest, based on relative bandwidth available between available colors, randomly assigned among available colors, based on geographic considerations, based on temporal considerations (such as weather, bandwidth usage, events, work patterns, days of the week, sporting events, and/or the like), and or the like. Previously, a terrestrial consumer broadband terminal was not capable of determining what color to use based on conditions at the moment of install or quickly, remotely varied during use.

In accordance with an exemplary embodiment, the system is configured to facilitate remote addressability of subscriber terminals. In one exemplary embodiment, the system is configured to remotely address a specific terminal. The system may be configured to address each subscriber terminal. In another exemplary embodiment, a group of subscriber terminals may be addressable. This may occur using any number of methods now known, or hereafter invented, to communicate instructions with a specific transceiver and/or group of subscriber terminals. Thus, a remote signal may command a terminal or group of terminals to switch from one color to another color. The terminals may be addressable in any suitable manner. In one exemplary embodiment, an IP address is associated with each terminal. In an exemplary embodiment, the terminals may be addressable through the modems or set top boxes (e.g. via the internet). Thus, in accordance with an exemplary embodiment, the system is configured for remotely changing a characteristic polarization of a subscriber terminal by sending a command addressed to a particular terminal. This may facilitate load balancing and the like. The sub-group could be a geographic sub group within a larger geographic area, or any other group formed on any suitable basis In this manner, an individual unit may be controlled on a one to one basis. Similarly, all of the units in a sub-group may be commanded to change colors at the same time. In one embodiment, a group is broken into small sub-groups (e.g., 100 sub groups each comprising 1% of the terminals in the larger grouping). Other sub-groups might comprise 5%, 10%, 20%, 35%, 50% of the terminals, and the like. The granularity of the subgroups may facilitate more fine tuning in the load balancing.

Thus, an individual with a four color switchable transceiver that is located at location A on the map (see FIG. 9, Practical Distribution Illustration), would have available to them colors U1, U2, and U3. The transceiver could be switched to operate on one of those three colors as best suits the needs at the time. Likewise, location B on the map would have colors U1 and U3 available. Lastly, location C on the map would have color U1 available. In many practical circumstances, a transceiver will have two or three color options available in a particular area.

It should be noted that colors U5 and U6 might also be used and further increase the options of colors to use in a spot beam pattern. This may also further increase the options available to a particular transceiver in a particular location. Although described as a four or six color embodiment, any suitable number of colors may be used for color switching as described herein. Also, although described herein as a satellite, it is intended that the description is valid for other similar remote communication systems that are configured to communicate with the transceiver.

The frequency range/polarization of the terminal may be selected at least one of remotely, locally, manually, or some combination thereof. In one exemplary embodiment, the terminal is configured to be remotely controlled to switch from one frequency range/polarization to another. For example, the terminal may receive a signal from a central system that controls switching the frequency range/polarization. The central system may determine that load changes have significantly slowed down the left hand polarized channel, but that the right hand polarized channel has available bandwidth. The central system could then remotely switch the polarization of a number of terminals. This would improve channel availability for switched and non-switched users alike. Moreover, the units to switch may be selected based on geography, weather, use characteristics, individual bandwidth requirements, and/or other considerations. Furthermore, the switching of frequency range/polarization could be in response to the customer calling the company about poor transmission quality.

It should be noted that although described herein in the context of switching both frequency range and polarization, benefits and advantages similar to those discussed herein may be realized when switching just one of frequency or polarization.

The frequency range switching described herein may be performed in any number of ways. In an exemplary embodiment, the frequency range switching is performed electronically. For example, the frequency range switching may be implemented by adjusting phase shifters in a phased array, switching between fixed frequency oscillators or converters, and/or using a tunable dual conversion transmitter comprising a tunable oscillator signal. Additional aspects of frequency switching for use with the present invention are disclosed in U.S. application Ser. No. 12/614,293 entitled "DUAL CONVERSION TRANSMITTER WITH SINGLE LOCAL OSCILLATOR" which was filed on Nov. 6, 2009; the contents of which are hereby incorporated by reference in their entirety.

In accordance with another exemplary embodiment, the polarization switching described herein may be performed in any number of ways. In an exemplary embodiment, the polarization switching is performed electronically by adjusting the relative phase of signals at orthogonal antenna ports. In another exemplary embodiment, the polarization switching is performed mechanically. For example, the polarization switching may be implemented by use of a trumpet switch. The trumpet switch may be actuated electronically. For instance, in one exemplary embodiment the system may be configured to communicate over commercial bandwidth demands (such as 17.7-20.2 GHz, and/or 27.5-30.0 GHz) using mechanical steering utilizing a trumpet switch. In this exemplary embodiment a phased array may be configured to have low noise amplifiers and power amplifiers at respective elements. The phased array may centrally form circular polarization using all or a portion of all of the receive vertical and horizontal ports. In another exemplary embodiment, the phased array may form circular polarization using all or a portion of all of the transmit vertical and horizontal ports.

For example, the trumpet switch may be actuated by electronic magnet, servo, an inductor, a solenoid, a spring, a motor, an electro-mechanical device, or any combination thereof. Moreover, the switching mechanism can be any mechanism configured to move and maintain the position of the trumpet switch. Furthermore, in an exemplary embodiment, the trumpet switch is held in position by a latching mechanism. The latching mechanism, for example, may be fixed magnets. The latching mechanism keeps the trumpet switch in place until the antenna is switched to another polarization.

As described herein, the terminal may be configured to receive a signal causing switching and the signal may be from a remote source. For example, the remote source may be a central office. In another example, an installer or customer can switch the polarization using a local computer connected to the terminal which sends commands to the switch. In another embodiment, an installer or customer can switch the polarization using the television set-top box which in turn sends signals to the switch. The polarization switching may occur during installation, as a means to increase performance, or as another option for troubleshooting poor performance.

In other exemplary embodiments, manual methods may be used to change a terminal from one polarization to another. This can be accomplished by physically moving a switch within the housing of the system or by extending the switch outside the housing to make it easier to manually switch the polarization. This could be done by either an installer or customer.

Some exemplary embodiments of the above mentioned multi-color embodiments may benefits over the prior art. For instance, in an exemplary embodiment, a low cost consumer broadband terrestrial terminal antenna system may include an antenna, a transceiver in signal communication with the antenna, and a polarity switch configured to cause the antenna system to switch between a first polarity and a second polarity. In this exemplary embodiment, the antenna system may be configured to operate at the first polarity and/or the second polarity.

In an exemplary embodiment, a method of system resource load balancing is disclosed. In this exemplary embodiment, the method may include the steps of: (1) determining that load on a first spotbeam is higher than a desired level and that load on a second spotbeam is low enough to accommodate additional load; (2) identifying, as available for switching, consumer broadband terrestrial terminals on the first spot beam that are in view of the second spotbeam; (3) sending a remote command to the available for switching terminals; and (4) switching color in said terminals from the first beam to the second beam based on the remote command. In this exemplary embodiment, the first and second spot beams are each a different color.

In an exemplary embodiment, a satellite communication system is disclosed. In this exemplary embodiment, the satellite communication system may include: a satellite configured to broadcast multiple spotbeams; a plurality of user terminal antenna systems in various geographic locations; and a remote system controller configured to command at least some of the subset of the plurality of user terminal antenna systems to switch at least one of a polarity and a frequency to switch from the first spot beam to the second spotbeam. In this exemplary embodiment, the multiple spot beams may include at least a first spotbeam of a first color and a second spotbeam of a second color. In this exemplary embodiment, at least a subset of the plurality of user terminal antenna systems may be located within view of both the first and second spotbeams.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. Furthermore, couple may mean that two objects are in communication with each other, and/or communicate with each other, such as two pieces of hardware. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

It should be appreciated that the particular implementations shown and described herein are illustrative of various embodiments including its best mode, and are not intended to limit the scope of the present disclosure in any way. For the sake of brevity, conventional techniques for signal processing, data transmission, signaling, and network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

The following applications are related to this subject matter: U.S. application Ser. No. 12/759,123, entitled "ACTIVE BUTLER AND BLASS MATRICES," which is being filed contemporaneously herewith; U.S. application Ser. No. 12/759,043, entitled "ACTIVE HYBRIDS FOR ANTENNA SYSTEMS," which is being filed contemporaneously herewith; U.S. application Ser. No. 12/759,064, entitled "ACTIVE FEED FORWARD AMPLIFIER," which is being filed contemporaneously herewith; U.S. application Ser. No. 12/759,130, entitled "ACTIVE PHASED ARRAY ARCHITECTURE," which is being filed contemporaneously herewith; U.S. application Ser. No. 12/759,059, entitled "MULTI-BEAM ACTIVE PHASED ARRAY ARCHITECTURE," which is being filed contemporaneously herewith; U.S. application Ser. No. 12/758,996, entitled "PRESELECTOR AMPLIFIER," which is being filed contemporaneously herewith; U.S. application Ser. No. 12/759,148, entitled "ACTIVE POWER SPLITTER," which is being filed contemporaneously herewith; U.S. application Ser. No. 12/759,112, entitled "HALF-DUPLEX PHASED ARRAY ANTENNA SYSTEM," which is being filed contemporaneously herewith; U.S. application Ser. No. 12/614,185 entitled "MOLDED ORTHOMODE TRANSDUCER" which was filed on Nov. 6, 2009; U.S. Provisional Application No. 61/113,517, entitled "MOLDED ORTHOMODE TRANSDUCER," which was filed on Nov. 11, 2008; U.S. Provisional Application No. 61/112,538, entitled "DUAL CONVERSION TRANSMITTER WITH SINGLE LOCAL OSCILLATOR," which was filed on Nov. 7, 2008; U.S. application Ser. No. 12/758,942, entitled "ELECTROMECHANICAL POLARIZATION SWITCH," which is being filed contemporaneously herewith; U.S. application Ser. No. 12/758,966, entitled "AUTOMATED BEAM PEAKING SATELLITE GROUND TERMINAL," which is being filed contemporaneously herewith; U.S. application Ser. No. 12/759,113, entitled "DIGITAL AMPLITUDE CONTROL OF ACTIVE VECTOR GENERATOR," which is being filed contemporaneously herewith; the contents of which are hereby incorporated by reference for any purpose in their entirety.

While the principles of the disclosure have been shown in embodiments, many modifications of structure, arrangements, proportions, the elements, materials and components, used in practice, which are particularly adapted for a specific environment and operating requirements without departing from the principles and scope of this disclosure. These and other changes or modifications are intended to be included within the scope of the present disclosure and may be expressed in the following claims.

The invention claimed is:

1. A system comprising:

a first plurality of waveguide elements; wherein the first plurality of waveguide elements are configured to communicate in a first frequency band;

a second plurality of waveguide elements interleaved in a housing with the first plurality of waveguide elements; wherein the second plurality of waveguide elements are configured to communicate in a second frequency band;

wherein the first plurality of waveguide elements and the second plurality of waveguide elements are integrally coupled to a printed circuit board; and wherein the system is capable of full duplex operation.

2. The system of claim 1, wherein the system is coupled to a phased array reflector dish RF antenna system.

3. The system of claim 2, wherein said RF antenna system does not comprise an OMT, polarizer, and feed horn.

4. The system of claim 2, wherein said RF antenna system is one of a point to point system and a satellite to terrestrial consumer terminal system.

5. The system of claim 1, wherein the first plurality of waveguide elements operate in at least one of a transmit frequency range and a receive frequency range; and wherein the second plurality of waveguide elements operate in at least one of a transmit frequency range and a receive frequency range.

6. The system of claim 1,wherein the system is configured to operate in a plurality of transmit frequency bands and a plurality of receive frequency bands.

7. The system of claim 1, wherein the first plurality of waveguide elements communicate with signals which are at least one of vertical polarization, horizontal polarization, right hand elliptical polarization, left hand elliptical polarization, right hand circular polarization, and left hand circular polarization and wherein the second plurality of waveguide elements communicate with signals which are at least one of vertical polarization, horizontal polarization, right hand elliptical polarization, left hand elliptical polarization, right hand circular polarization, and left hand circular polarization.

8. The system to claim 1, wherein at least one of (a) the first plurality of waveguide elements are ridge loaded waveguide radiating elements; and (h) the second plurality of waveguide elements are ridge loaded waveguide radiating elements.

9. The system of claim 1, wherein the system is configured so that a transmitted signal and a received signal have substantially co-located phase centers.

10. The system of claim 1, wherein the first plurality of waveguide elements comprise an aperture plate.

11. The system of claim 1, wherein the first plurality of waveguide elements are one of equal size as compared with the second plurality of waveguide elements and unequal size as compared with the second plurality of waveguide elements.

12. The system of claim 1, wherein the first plurality of waveguide elements are sized to filter signals other than the transmit signals and the second plurality of waveguide elements are sized to filter signals other than the receive signals.

13. The system of claim 1, further comprising a high pass filter, wherein the high pass filter is configured to reject HPA noise.

14. The system of claim 1, wherein the system is at least partially implemented integral to a MMIC chip.

15. The system of claim 1, wherein the first plurality of waveguide elements operate in a frequency between about 14 GHz and 31.5 GHz and wherein the second plurality of waveguide elements operate in a frequency between about 10.7 GHz and 21.2 GHz.

16. The system of claim 1, wherein the system is coupled to a panel antenna.

17. The system of claim 1, wherein the system is coupled to a phased array feed.

18. The system of claim 1, wherein the system comprises a plurality of single mode waveguide elements which may be combined to communicate in a plurality of polarizations.

19. The system of claim 1, wherein the system is configured for broad band operation.

20. A method for communicating RF signals comprising:

transmitting a first signal via a first plurality of waveguide elements; wherein the first plurality of waveguide elements are configured to communicate in a first frequency band;

receiving a second signal via a second plurality of waveguide elements interleaved with the first plurality of waveguide elements in a housing; wherein the second plurality of waveguide elements are configured to communicate in a second frequency band;

wherein the first plurality of waveguide elements and the second plurality of waveguide elements are integrally coupled to a printed circuit board; and wherein the RF signals may be communicated in full duplex operation.

* * * * *

UNITED STATES PATENT AND TRADEMARK OFFICE

CERTIFICATE OF CORRECTION

PATENT NO. : 8,587,492 B2
APPLICATION NO. : 12/758914
DATED : November 19, 2013
INVENTOR(S) : Donald Lawson Runyon It is certified that error appears in the above-identified patent and that said Letters Patent is hereby corrected as shown below:

In the Claims

Column 30, Lines 26 and 28 should read

Claim 8. The system of claim 1, wherein at least one of (a) the first plurality of waveguide elements are ridge loaded waveguide radiating elements; and (b) the second plurality of waveguide elements are ridge loaded waveguide radiating elements.

Signed and Sealed this
Twenty-fifth Day of February, 2014

Michelle K. Lee

Michelle K. Lee
*Deputy Director of the United States Patent and Trademark Office*